US008156952B2

(12) United States Patent
Chesness

(10) Patent No.: US 8,156,952 B2
(45) Date of Patent: Apr. 17, 2012

(54) PORTABLE TENT

(76) Inventor: Curtis J. Chesness, Andover, MN (US)

( * ) Notice: Subject to any disclaimer, the term of this patent is extended or adjusted under 35 U.S.C. 154(b) by 0 days.

(21) Appl. No.: 12/248,532

(22) Filed: Oct. 9, 2008

(65) Prior Publication Data

US 2009/0145471 A1 Jun. 11, 2009

Related U.S. Application Data

(60) Provisional application No. 60/998,274, filed on Oct. 9, 2007.

(51) Int. Cl.
*E04H 15/48* (2006.01)
*E04H 15/32* (2006.01)

(52) U.S. Cl. ..... 135/123; 135/147; 135/152; 135/905; 52/79.5; 52/83

(58) Field of Classification Search ..... 135/121–123, 135/127, 130, 135, 143–144, 147, 151–154, 135/156, 120.4, 905; 52/82–83, 80.1, 79.5; 211/119.01, 119.04, 119.16
See application file for complete search history.

(56) References Cited

U.S. PATENT DOCUMENTS

| | | | | |
|---|---|---|---|---|
| 1,491,849 | A * | 4/1924 | Dickey | 135/98 |
| 2,015,321 | A * | 9/1935 | Shelton | 135/98 |
| 2,677,384 | A * | 5/1954 | Luisada | 135/123 |
| 3,289,787 | A | 12/1966 | McSwain | |
| 3,338,285 | A | 8/1967 | Jaster | |
| 3,364,530 | A | 1/1968 | Kraus | |
| 4,074,682 | A * | 2/1978 | Yoon | 135/135 |
| 4,880,024 | A * | 11/1989 | Brell | 135/122 |
| 4,947,884 | A * | 8/1990 | Lynch | 135/97 |
| 5,230,196 | A * | 7/1993 | Zeigler | 52/646 |
| 5,230,358 | A * | 7/1993 | Forell | 135/98 |
| 5,634,483 | A * | 6/1997 | Gwin | 135/131 |
| 5,655,340 | A * | 8/1997 | Pelsue | 52/71 |
| 5,884,646 | A * | 3/1999 | Ju | 135/135 |
| 5,927,435 | A | 7/1999 | Benton | |
| 7,509,967 | B2 * | 3/2009 | Kim | 135/135 |
| 7,556,054 | B2 * | 7/2009 | Zeigler | 135/145 |

(Continued)

FOREIGN PATENT DOCUMENTS

DE 2162124 7/1972

(Continued)

OTHER PUBLICATIONS

Exhibit 5, filed in U.S. Appl. No. 11/744,398 in amendment filed on Jan. 17, 2008 which was in response to office action dated Jul. 17, 2007.

IPRP mailed Apr. 22, 2010 for PCT Application No. PCT/US2008/079361.

Search Report & Written Opinion mailed Dec. 3, 2009 for PCT Application No. PCT/US2008/079361.

(Continued)

*Primary Examiner* — Winnie Yip
(74) *Attorney, Agent, or Firm* — Brett A. Klein

(57) ABSTRACT

A tent frame is disclosed including at least three support legs. The at least three support legs may have a connected end and a free end and may include a collapsible truss with at least two compression members, a hinge situated between the compression members, and a tension member extending from a first point near the free end to a second point near the connected end. The at least three support legs may be joined at their respective connected ends. A tent is also disclosed including a collapsible frame and a shell adapted to cover the frame, the shell having at least one window opening and at least one window curtain covering the at least one window opening, the at least one window curtain being adapted to slidably open and close. A method of setting up a tent is also described.

11 Claims, 41 Drawing Sheets

U.S. PATENT DOCUMENTS

| | | | | |
|---|---|---|---|---|
| 7,575,010 | B2 * | 8/2009 | Rottmann | 135/123 |
| 7,644,721 | B2 * | 1/2010 | Hoberman et al. | 135/144 |
| 2006/0138911 | A1 | 6/2006 | Ransom | |
| 2007/0199769 | A1 | 8/2007 | Chesness et al. | |

FOREIGN PATENT DOCUMENTS

| | | |
|---|---|---|
| DE | 3718052 | 12/1988 |
| GB | 760960 | 11/1956 |
| WO | 2006/076700 | 7/2006 |

* cited by examiner

PORTABLE TENT

CROSS REFERENCE TO RELATED APPLICATIONS

The present application claims priority to Provisional Application with Ser. No. 60/998,274 filed on Oct. 9, 2007, titled Hunting Tent, the contents of which are hereby incorporated by reference herein.

FIELD OF THE INVENTION

This invention relates generally to the field of indoor/outdoor enclosures. More particularly, the present invention relates to a portable tent. Even more particularly, the invention relates to a portable hunting tent.

BACKGROUND OF THE INVENTION

Tents for camping, hunting, photography, or other uses have been available for a long time. These tents have evolved over time. Early tent construction involved draping a protective covering over a series of vertical supports and anchoring the perimeter of the tent to the ground with rope ties. Later tent designs involved an exterior support system involving a series of rigid shaped supports sleeved through exterior sleeves on the outer surface of the tent wall, the supports arching over the tent and allowing the tent to hang from the supports and also be stretched and held open by the supports. In many cases these exterior supports crossed over each other in the shape of an 'X' for more stability. More recently, tents have been constructed with flexible rods also sleeved through exterior sleeves in the tent wall. These tents often have a dome shape and are supported by the arching action of a flexible rod whose ends are pinned in position.

Many of the later tent designs have been equipped with doors, windows, and air vents created by making openings in the material of the tent wall. These openings have included screening to allow air to flow through and keep out unwanted bugs or debris. Often, the window and door openings also include a portion of the tent wall material to cover the openings for more protection against exterior elements like cold and rain. In some cases, the portion of material for covering the opening may simply be a flap of material which can be unfolded or unrolled and stayed with ties. In the case of doors, the material may include zippers for opening and closing the door. These may occur on both the tent material portion and the screen covering the opening to facilitate passage through the opening.

Many of the tent designs described, as well as other designs, suffer from several drawbacks. First, due to their temporary and portable nature, tent structures are often made of light weight materials, which can lead to only marginally sturdy enclosures. Additionally, the fabrics of the tents can expand and shrink due to weather conditions or storage conditions. When they shrink, they can be difficult to assemble because they may not cooperate as well with the support structure. When they expand, they may tend to flap in the wind leading to noise. This flapping noise can be bothersome to those trying to enjoy the outdoors and may be even more detrimental to the outdoor experience where the tent is used for hunting or photographing wild animals. Worse yet, the flapping loose material can lead to tearing. In order to make the support structure portable, tents are often made of several parts requiring assembly and making the tent difficult to set up. Finally, in the case of cross-braced supports, as described above, the cross-bracing can obstruct the view from the inside of the tent.

There is a need in the art for a tent structure that requires little or no assembly of the parts necessary for setting up the tent. There is also a need for the tent to be sturdy. Moreover, there is a need in the art for a tent that is adjustable to accommodate shrinking or expanding material. There is also a need for a tent that is quiet and that provides for unobstructed views from the inside of the tent.

SUMMARY OF THE INVENTION

In one embodiment, a tent frame includes at least three support legs, the at least three support legs having a connected end and a free end, the at least three support legs comprising a collapsible truss including at least two compression members, a hinge situated between the compression members, and a tension member extending from a first point near the free end to a second point near the connected end, wherein the at least three support legs are joined at their respective connected ends. In another embodiment, the at least two compression members may include a roof pole and a wall pole. In another embodiment, the hinge may include a hinge pin and the hinge may be adapted to allow relative rotation of the roof pole and the wall pole about the hinge pin, the relative rotation limited to approximately 235 degrees. In still another embodiment, the frame may further include a compression hub wherein the at least three support legs are joined at their respective connected ends via a pivotal attachment between the roof pole and the compression hub. In yet another embodiment, the frame may further include a tension hub wherein the at least three support legs are joined at their respective connected ends via an additional attachment between the tension member and the tension hub. In yet another embodiment, the support legs may further include telescoping rods extendable from the sleeve end of their respective wall poles.

In another embodiment, a tent frame includes at least three support legs, the support legs each including a means for collapsing the support leg and a means for stabilizing the support leg when in a set up position. The frame may further include a means for actuating the stabilizing means.

In another embodiment, a method of setting up a tent includes providing a collapsible tent in the collapsed position, placing the collapsible tent on the ground thereby defining a center of the tent, unfolding at least three wall poles down about a first end from a generally vertical position to a generally horizontal position, each wall pole directed radially away from the center of the tent once unfolded, lifting at least three hinges diagonally upward away from the ground and outward away from the center of the tent, the hinge connected to an end of the wall pole near the center of the tent and connected to an end of a roof pole near the ground, wherein lifting the at least three hinges causes at least three support legs to be mostly formed, and tensioning at least three cables associated with the at least three support legs.

In still another embodiment, a tent includes a collapsible frame and a shell adapted to cover the frame, the shell having at least one window opening and at least one window curtain covering the at least one window opening, the at least one window curtain being adapted to slidably open and close.

While the present disclosure is directed toward a hunting tent, further areas of applicability will become apparent from the description provided herein. It should be understood that the description and specific examples are intended for purposes of illustration only and are not intended to limit the scope of the present disclosure.

DESCRIPTION OF THE DRAWINGS

The forgoing features, objects, and advantages of the invention will become apparent to those skilled in the art from the following detailed description, especially when considered in conjunction with the accompanying drawings in which like the numerals in the several views refer to corresponding parts.

DETAILED DESCRIPTION

The following description relates to several embodiments of a tent. Specifically, these embodiments may include elements that are advantageous for hunting or even wildlife photography. As such, the tent disclosed herein may be portable, light weight, and sturdy. The tent described herein may also provide for the stillness and thus quietness required for such activities and may also provide clear unobstructed views.

The tent described may take the form of a backpack or duffel bag when collapsed. The tent may be expandable without involving assembly of separate parts. This may be in the form of an expandable frame adapted to provide for hinged and/or telescopic expansion and the tent may have an outer shell that fits over the frame. The expandable frame may be a truss type frame for further stability. Consistent with avoiding assembly, the shell may be in place in a collapsed position and may expand along with the frame. The frame may be adjustable to maintain a taut outer shell. The tent may have openings in the form of windows, doors, and vents in the outer shell and these openings may be adapted to provide for extremely quiet use when closing or opening them. The tent openings may include screens and the screens may be removable or operable to provide for shooting from within the tent. Additionally, the support structure or frame may be arranged to avoid obstructing a view out of the windows of the tent.

Figure 1:
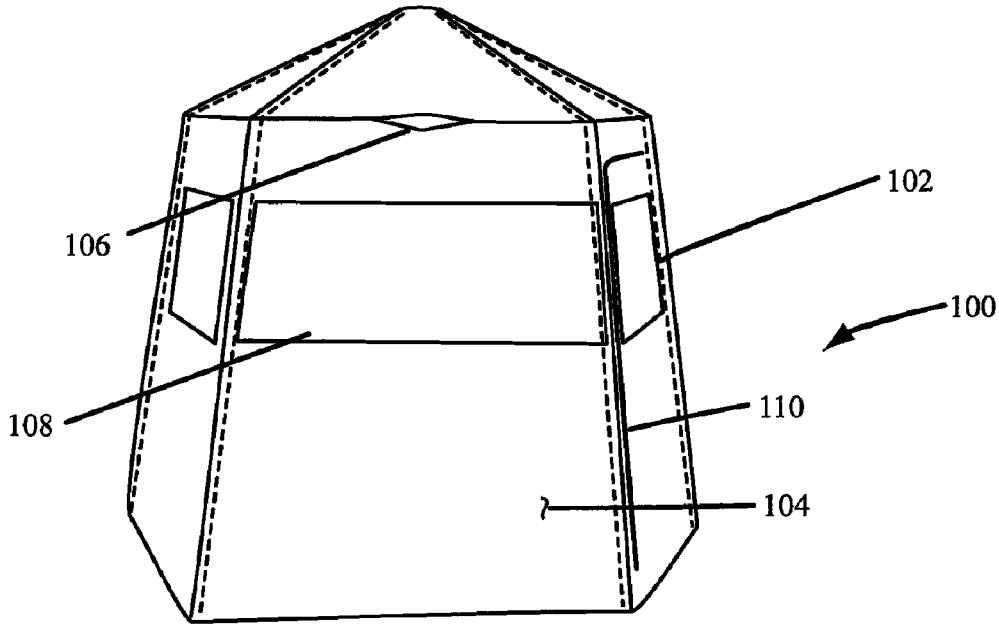
FIG. 1 is an exterior side view of a tent according to certain embodiments.

Referring now to FIG. 1, one embodiment of a tent 100 is shown. The tent 100 may have a frame 102 providing for a five sided tent 100. In a set up position, the frame 102 may converge toward the center and top of the tent 100 to form a roof. The tent 100 may include a shell 104 adapted to cover the frame 102 and may include openings including vents 106, windows 108, and doors 110. The following discussion will begin with a detailed discussion of the frame 102 and will move on to a detailed discussion of the shell 104.

Figure 2:
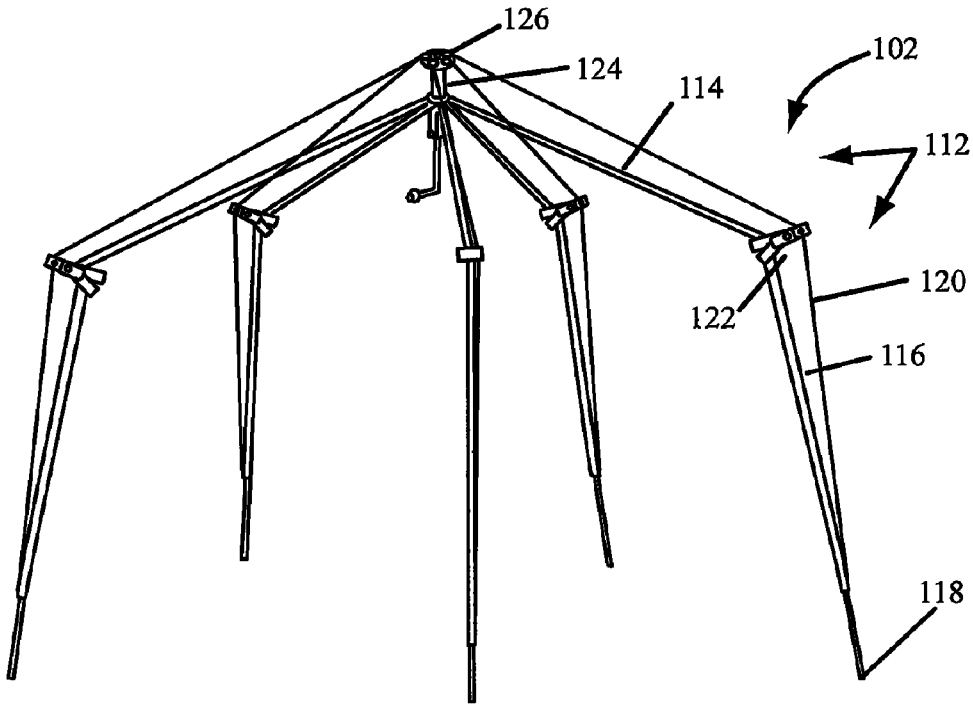
FIG. 2 is a view of a frame of a tent according to certain embodiments.

Referring now to FIG. 2, the frame 102 may include a series of truss type support legs 112 including compression members made up of a roof pole 114, a wall pole 116, and a telescoping rod 118. Each support leg 112 may also include a tension member in the form of a cable 120 extending along the length of the support leg 112 along a path resembling, but offset from, the contour of the support leg 112. The telescoping rod 118 may telescope within the wall pole 116 and the wall pole 116 may be connected to the roof pole 114 with a hinge 122. The roof pole 114 and the cable 120 may each converge at separate hubs 124,126 with other roof poles 114 and cables 120, respectively, the other roof poles 114 and cables 120 being associated with other support legs 112 in the series of support legs 112. Both the roof pole hub 124 and the cable hub 126 may be located near the top and near the center of the frame 102. The roof pole hub 124 and the cable hub 126 may also be adjustable relative to each other to provide for adjusting tension in the cable 120 and in turn compression in the support leg 112.

Figure 3:
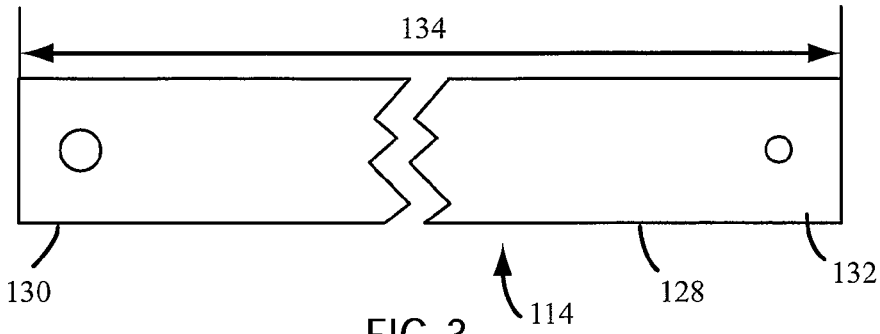
FIG. 3 is side view of a roof pole of a frame according to certain embodiments.

Referring now to FIG. 3, the roof pole 114 may include a cylindrical hollow tube 128 with an inner diameter and an outer diameter. The roof pole 114 may have a hub end 130 and a hinge end 132 defining a length 134. The roof pole 114 may also have holes or a fixture on the hub end 130 and hinge end 132 for attachment to the roof pole hub 124 and the hinge 122, respectively. It is noted that the roof pole 114 may also be referred to as an upper pole as this is located closer to the top of the frame 102 in an expanded state.

Figure 4:
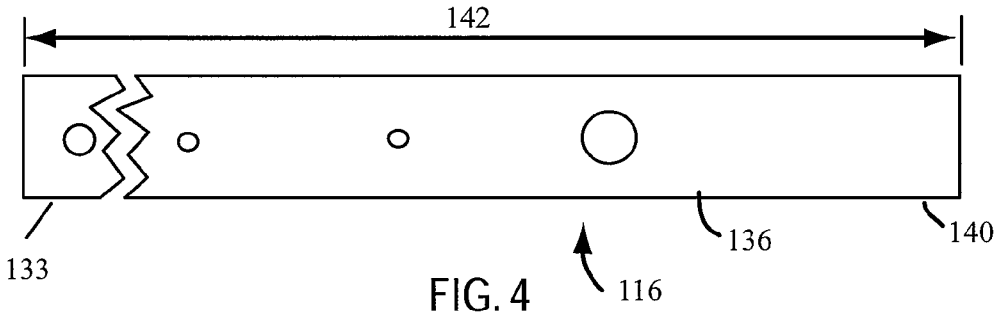
FIG. 4 is side view of a wall pole of a frame according to certain embodiments.

Similarly, referring now to FIG. 4, the wall pole 116 may include a cylindrical hollow tube 136 with an inner diameter and an outer diameter. The wall pole 116 may have a hinge end 133 and a sleeve end 140 defining a length 142. The wall pole 116 may also have holes or a fixture on the hinge end 133 and sleeve end 140 for attachment to the hinge 122 and the telescoping rod 118, respectively. It is noted that the wall pole 116 may also be referred to as a lower pole as this is located closer to the bottom of the frame 102 in an expanded state.

Figure 5:
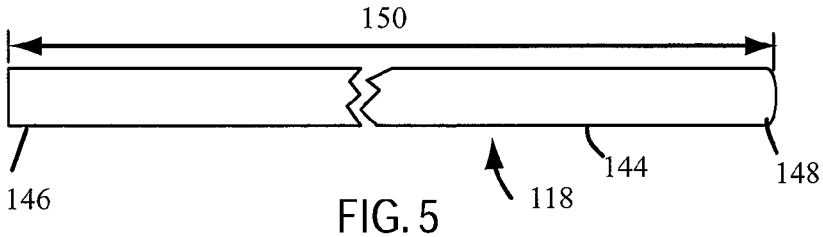
FIG. 5 is a side view of a telescoping rod according to certain embodiments.
Figure 6:
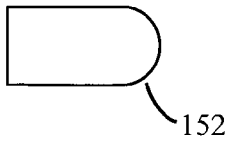
FIG. 6 is a side view of a boot for a tent engaging end of a telescoping rod according to certain embodiments.
Figure 7:
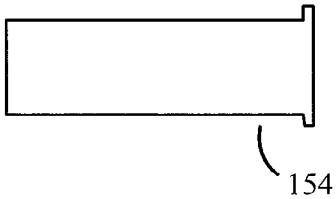
FIG. 7 is a side view of a bushing for the sliding attachment of a telescoping rod to a wall pole according to certain embodiments.

Referring now to FIG. 5, the telescoping rod 118 may include a cylindrical solid shaft 144 with an outer diameter. The telescoping rod 118 may have a sleeve end 146 and a free end 148 defining a length 150. The sleeve end 146 may be adapted to sleeve within the inner diameter of the wall pole 116 and the free end 148 may be adapted to connect with the bottom edge of the tent 100 and may be adapted to engage the ground. As shown in FIG. 6, the free end 148 may be covered with a boot 152 for protecting the telescoping rod 118 and covering any sharp edges. The boot 152 may be a rubber material adapted to grip surfaces it comes into contact with. Additionally, as shown in FIG. 7, a bushing 154 may be placed in the sleeve end 140 of the wall pole 116 for receiving the telescoping rod 118. This bushing 154 may include a cylindrical shaft portion and a flange portion. The cylindrical shaft portion may be adapted for a snug fit within the wall pole 116 and the flange portion may be adapted to prevent the bushing 154 from fully traveling inside the wall pole 116. The cylindrical portion may be further adapted for sliding engagement with the telescoping rod 118.

Figure 8:
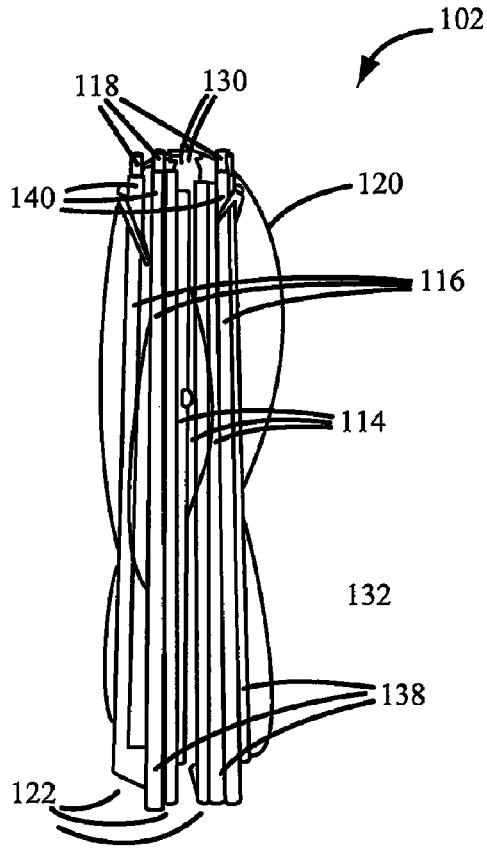
FIG. 8 is a collapsed view of a frame according to certain embodiments.
Figure 9:
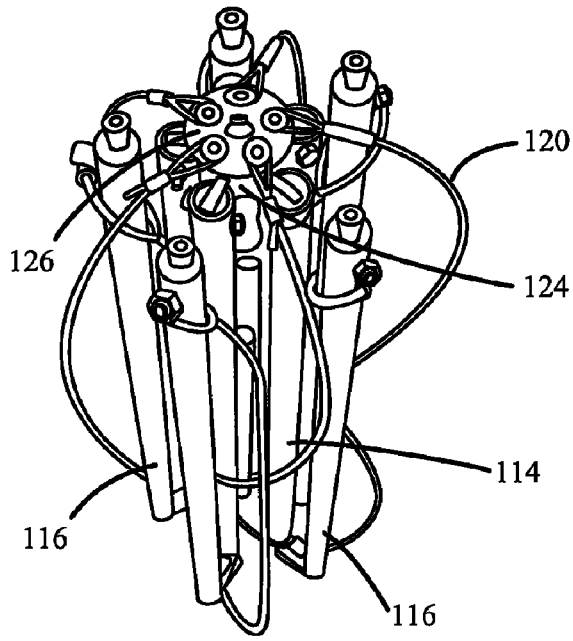
FIG. 9 is a close up top view of a collapsed frame according to certain embodiments.

A discussion of the process of setting up the frame 102 is necessary to further explain the detailed elements of the frame 102. Referring to FIG. 8, a collapsed view of the frame 102 is shown. The figure shows the wall poles 116 in a vertical position defining an outer circle of the collapsed frame 102. The wall poles 116 are positioned with the hinge end 138 at the bottom and the sleeve end 140 at the top. The figure further shows the roof poles 114 in a vertical position defining an inner circle of the collapsed frame. The roof poles 114 are positioned with the hub end 130 at the top and the hinge end 132 at the bottom. The figure also shows the telescoping rods 118 with the sleeve end 146 telescoped inside the wall pole 116 and the free end 148 projecting minimally out the sleeve end 140 of the wall pole 116 with a boot 152. Also shown is a hinge 122 between the roof pole 114 and the wall pole 116. A cable 120 is also shown extending from the cable hub 126 to a connection near the sleeve end 140 of the wall pole 116. Near the top of the collapsed frame 102, as more clearly shown in the close-up view of FIG. 9, is a cable hub 126 and a roof pole hub 124. As shown, the roof poles 114, defining the inner circle of poles, have a pivotal attachment to the roof pole hub 124 and the cables 120 are attached to the cable hub 126.

Figure 10:
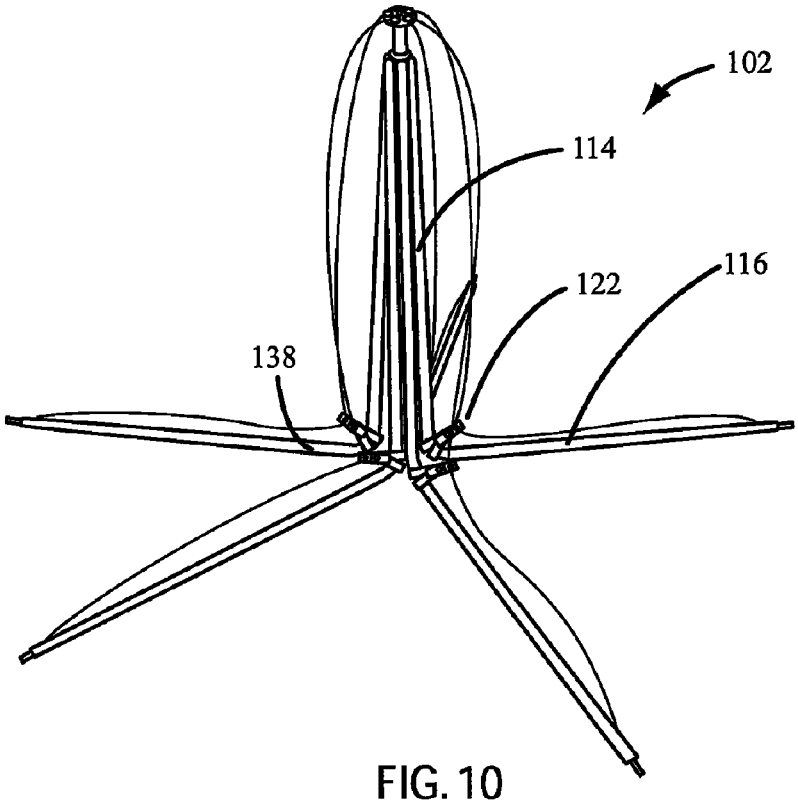
FIG. 10 is a frame at one of several stages of expansion according to certain embodiments.

FIG. 10 is a view of one embodiment where the frame 102 is in an initial stage of expansion in the set up process. As shown, the wall poles 116 have been rotated approximately 90 degrees relative to their initial vertical position and relative to the position of the roof poles 114. The wall pole 116, in this embodiment, rotates about the hinge end 138 and the rotation relative to the roof pole 114 is accommodated by the hinge 122 between the roof pole 114 and the wall pole 116.

Figure 11:
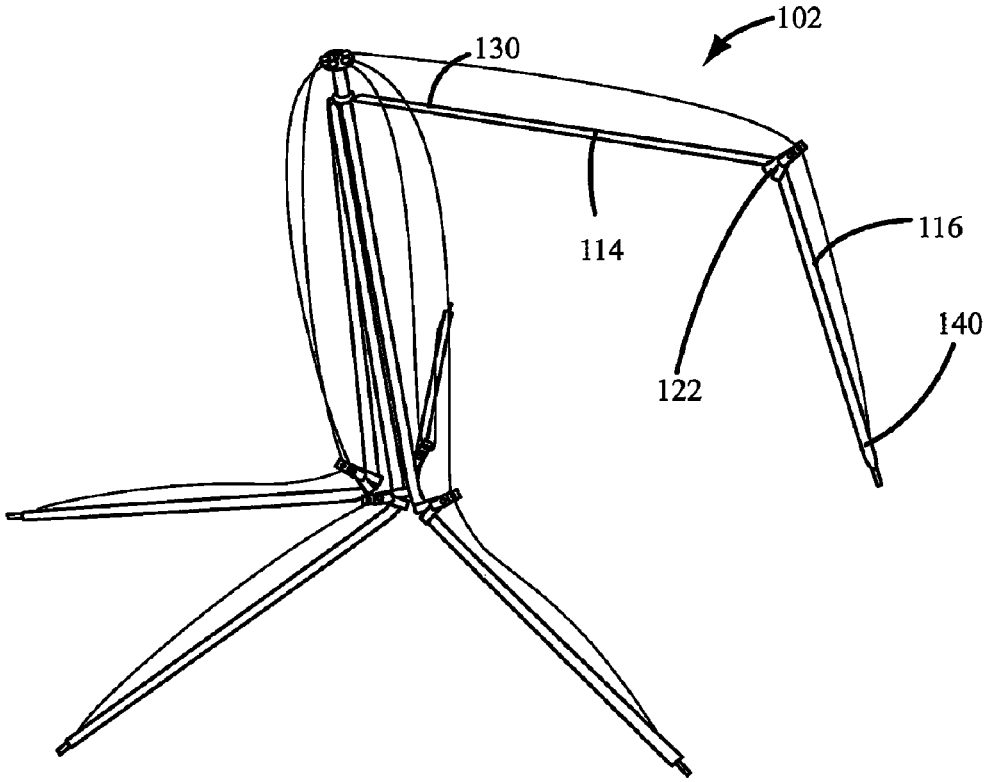
FIG. 11 is a frame at one of several stages of expansion according to certain embodiments.
Figure 12:
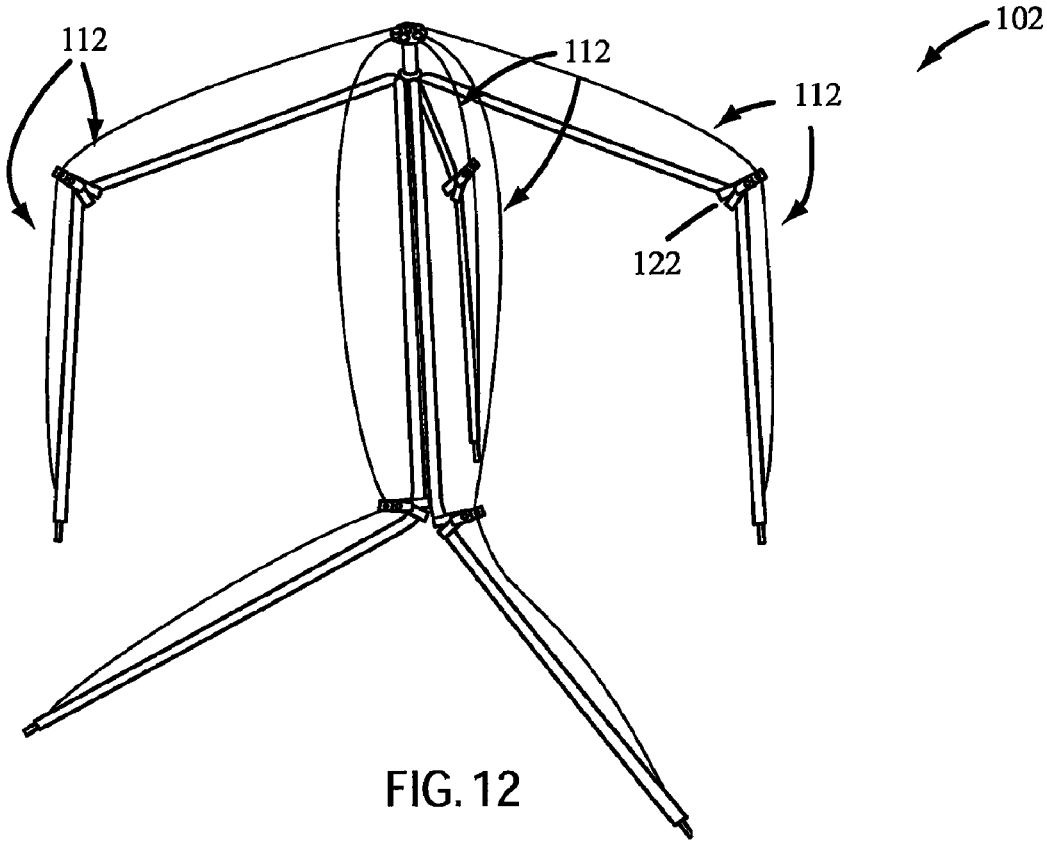
FIG. 12 is a frame at one of several stages of expansion according to certain embodiments.
Figure 13:
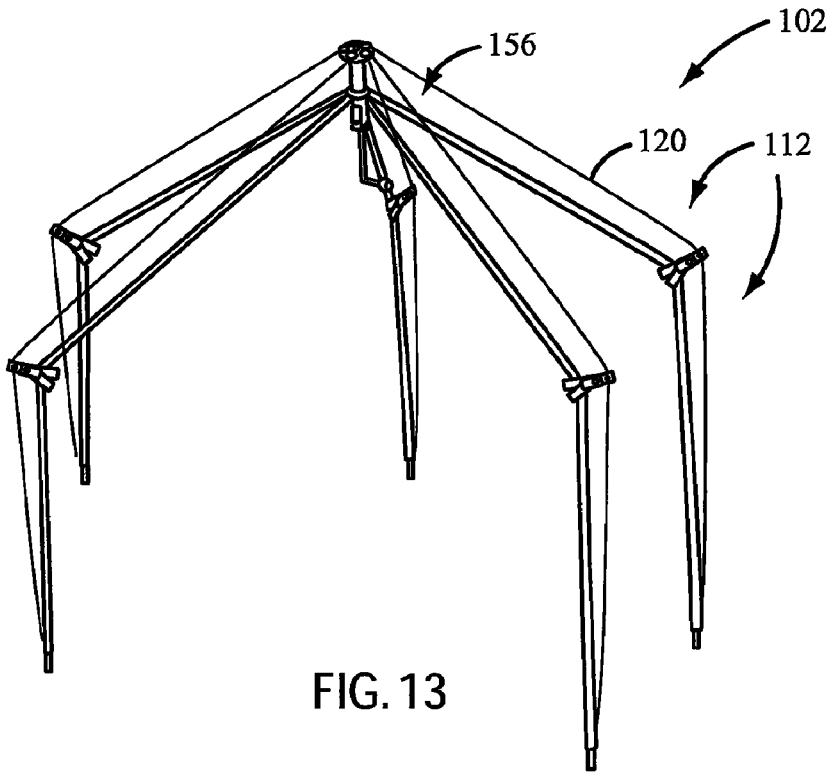
FIG. 13 is a frame at one of several stages of expansion according to certain embodiments.

FIG. 11 is a view of another stage of expansion of the frame 102. As shown, the hinge 122 between the roof pole 114 and the wall pole 116 has been moved from the base of the collapsed frame 102 to a location upward and outward from the base and in the plane defined by the associated wall pole 116 and roof pole 114 in the previous position. This movement has caused the wall pole 116 to rotate about its sleeve end 140 an additional 65 to 85 degrees, approximately, relative to its previous position. The movement of the hinge 122 has also caused the roof pole 114 to rotate about its hub end 130 approximately 60 to 80 degrees relative to its previous vertical position. Thus, the rotation of the roof pole 114 and wall pole 116 relative to each other may be from approximately 210 degrees to approximately 260 degrees. In one embodiment, this relative rotation is approximately 235 degrees. In FIG. 12, two additional support legs 112 are expanded by moving the hinge 122 from the base of the collapsed frame 102 to a position outward and upward from the base position. In FIG. 13, all five support legs 112 have been expanded. At this point, as will be described in more detail later in the specification, the crank assembly 156 at the top of the frame 102 may be used to provide an initial amount of tension in the cables 120 to secure the shape of the frame 102.

Figure 14:
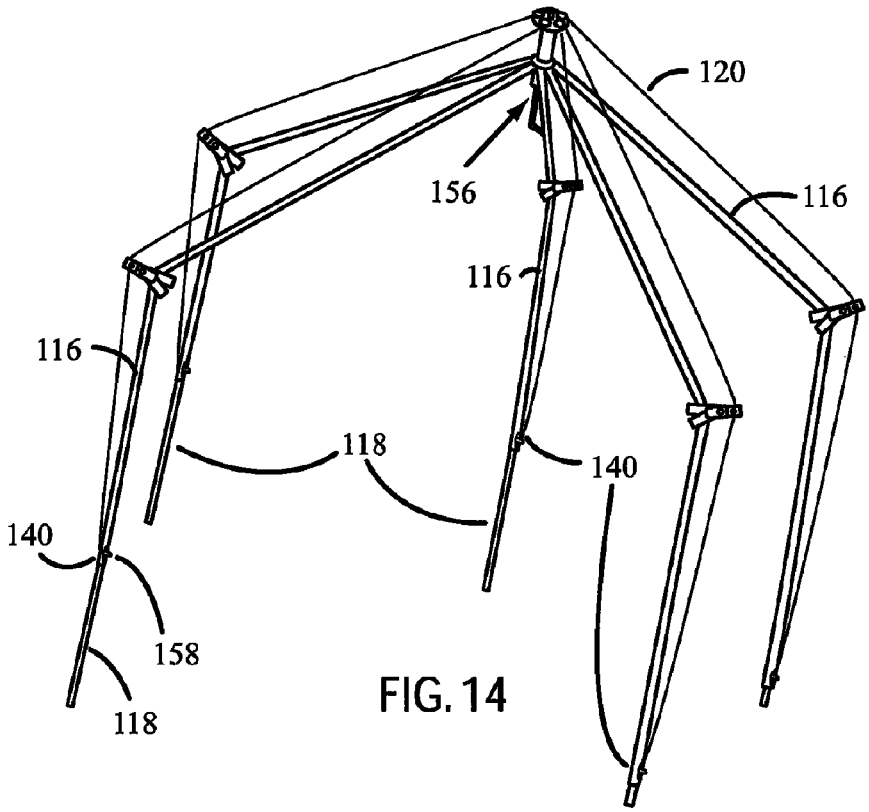
FIG. 14 is a frame at one of several stages of expansion according to certain embodiments.
Figure 15:
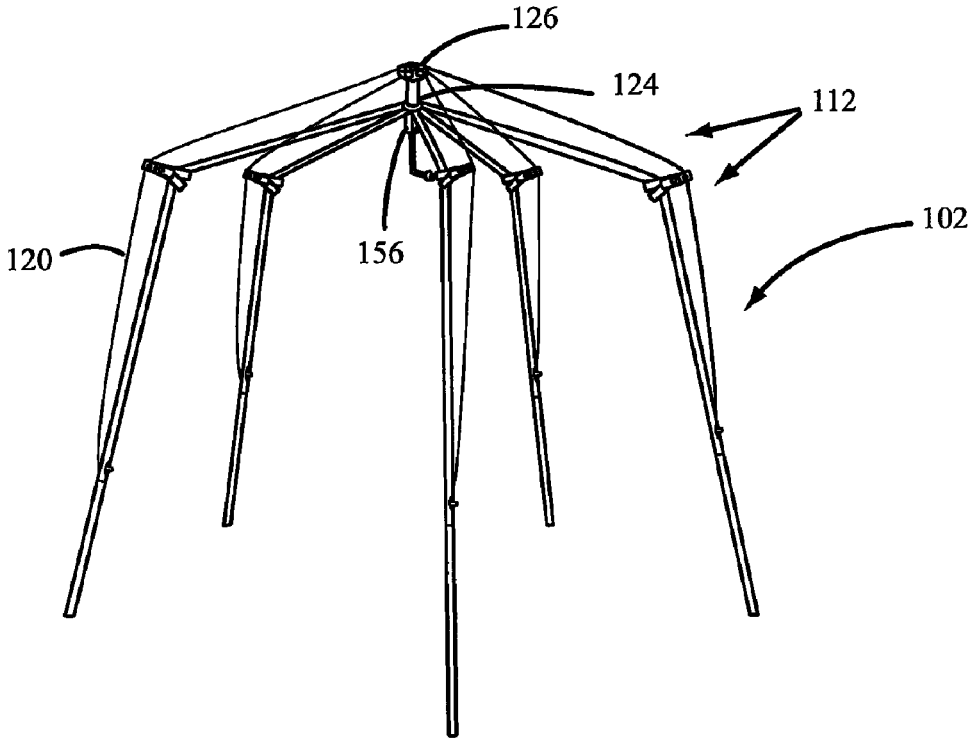
FIG. 15 is a fully expanded frame according to certain embodiments.

Referring now to FIG. 14, three of the telescoping rods 118 have been extended out of the sleeve end 140 of their associated wall poles 116 and have been secured in position with a spring ball 158. Also shown in FIG. 14 is a crank assembly 156 for tensioning the cables 120. In FIG. 15, the frame 102 is fully expanded and in a set up position. In this position, the crank assembly 156 may be rotated to raise the cable hub 126 relative to the roof pole hub 124 causing tension in the cables 120 of each support leg 112 simultaneously. In the present embodiment, the shell 104 of the tent 100 rests against the outer face of this cable 120 on each of the support legs 112. Thus, extending the cable hub 126 upward may tighten the roof portion of the shell 104 (not shown) as well as the wall portion. This may also stiffen the frame 102. It is noted that the circumferential ring shown at the base of the frame is in place only as a lateral restraint in the absence of a shell 104. In use as shown later, the frame 102 may be expanded with the shell 104 in place and this circumferential ring is not necessary.

Figure 16:
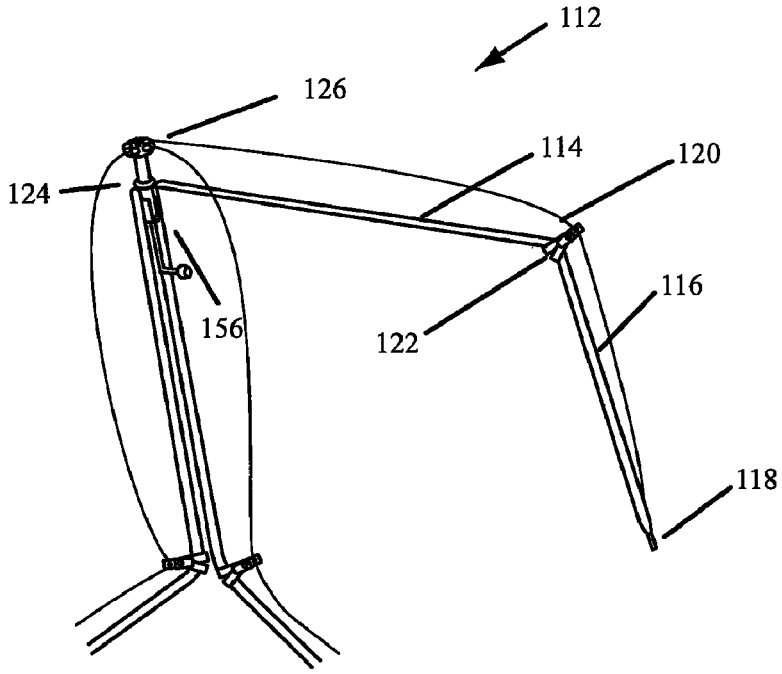
FIG. 16 is a detailed view of a single leg of a frame according to certain embodiments

FIG. 16 shows a more detailed view of an expanded support leg 112 of a frame 102. The figure shows a crank assembly 156, a roof pole hub 124, a cable hub 126, a roof pole 114, a hinge 122, a wall pole 116, and telescoping rod 118, and a cable 120. The details of the interactions of each of these elements will now be described in further detail.

Figure 17:
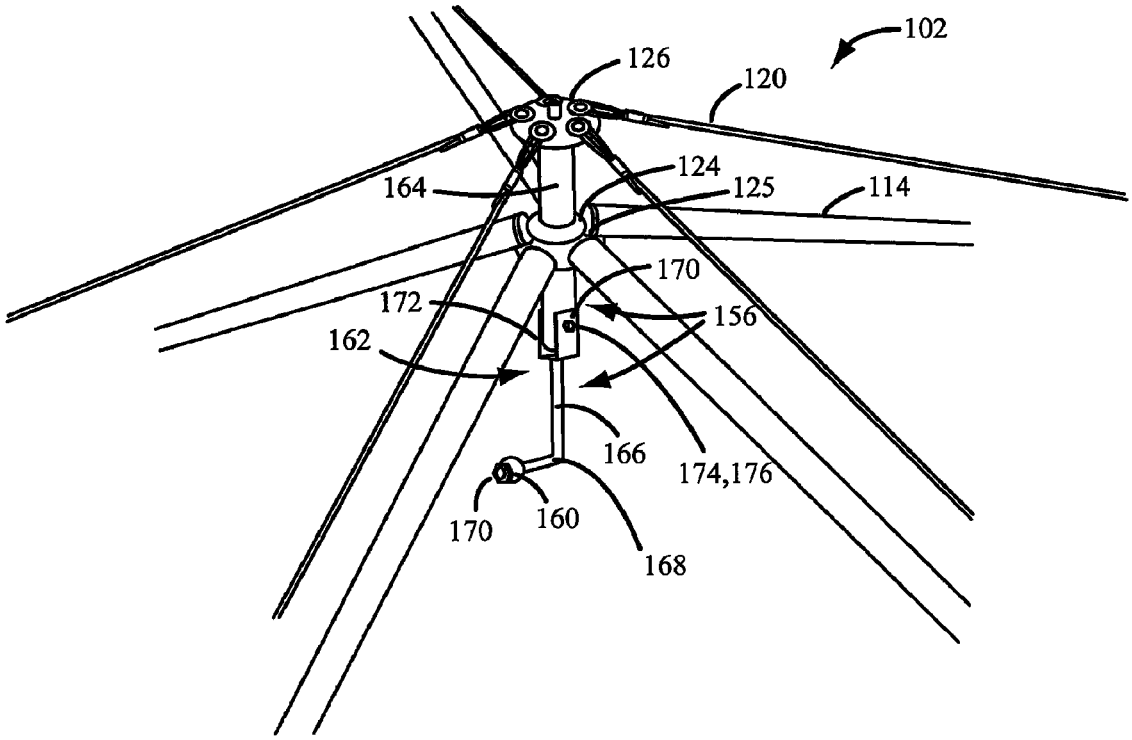
FIG. 17 is a detailed view of a cable hub and a roof pole hub according to certain embodiments.

FIG. 17 shows a close-up side and top view of a top of an expanded frame 102 according to certain embodiments. The figure shows a roof pole hub 124 with five roof poles 114 pivotally attached to it. The figure also shows a cable hub 126 with five cables 120 attached to it, the cables 120 corresponding to the roof poles 114. Additionally shown is a crank assembly 156 extending through the roof pole hub 124 and up to the cable hub 126. The roof pole hub 124 may be referred to as a compression hub as it is adapted to resist the radial compressive forces of the multiple roof poles 114 leaning in upon the hub. In contrast, the cable hub 126 may be referred to as a tension hub as it is adapted to resist the radial tension forces of the multiple cables 120 pulling radially outward upon the hub.

In further reference to FIG. 17, the crank assembly 156 shown includes a knob 160, a handle 162, and a threaded rod 164. The knob 160 may include a spherical shaped object with a bore for receiving the handle 162. In the present embodiment, the handle 162 includes a bent rod 166 with a knob end 168 and a threaded rod end 170. At the knob end 168, the handle 162 includes threads for receiving a nut 170, preferably a lock nut. The knob end 168 may be inserted through the bore of the knob 160 and the knob 160 may be secured on the handle 162 with the nut 170. The bore may be sized for a loose fit to allow the knob 160 to freely rotate on the handle 162. At the threaded rod end 170 of the handle 162, the handle 162 may include a U-shaped plate 172 for receiving the threaded rod 164. The U-shaped plate 172 may include holes aligned with a transverse bore through the threaded rod 164. The U-shaped plate 172 may be attached to the threaded rod 164 with a bolt 174 and a nut 176. The connection may prevent relative rotation between the handle 162 and the threaded rod 164, but may allow for a pivoting motion relative to each other. That is, the U-shaped plate 172 connection may allow a longitudinal axis of each to rotate relative to one another about the axis of the bolt 174. However, the longitudinal axis of each is not free to rotate relative to the longitudinal axis of the other. Thus, when the handle 162 is rotated, the threaded rod 164 rotates accordingly.

In the present embodiment, the roof pole hub 124 includes a threaded bore through its center for receiving the threaded rod 164. The threaded rod 164, as discussed, is connected to the handle 162 at one end. The threaded rod 164 then passes through the threaded bore of the roof pole hub 124 and connects to the cable hub 126. Thus, as the crank assembly 156 is rotated clockwise (e.g. when viewed from the bottom as one would if they were inside the tent looking upward at the crank assembly), the threaded rod 164 travels upward through the roof pole hub 124 causing the cable hub 126 to extend upward relative to the roof pole hub 124.

Continuing the reference to FIG. 17, the pivotal attachment between the roof poles 114 and the roof pole hub 124 may include a plate 125 positioned vertically and protruding from the roof pole hub 124. The plate 125 may be received by the roof pole 114 in a slot and a through bolt may be provided through the roof pole 114 and the plate 125. Additionally, the cables 120 for each support leg 112 may include a loop and may be attached to the cable hub 126 with a rivet, bolt, or other attachment known in the art for attaching cable 120 with connection loops. As shown, the cable loop is formed by folding the cable 120 onto itself and attaching it to itself with a crimp. Alternatively, a wire rope clip or other connections known in the art could be used.

Figure 18:
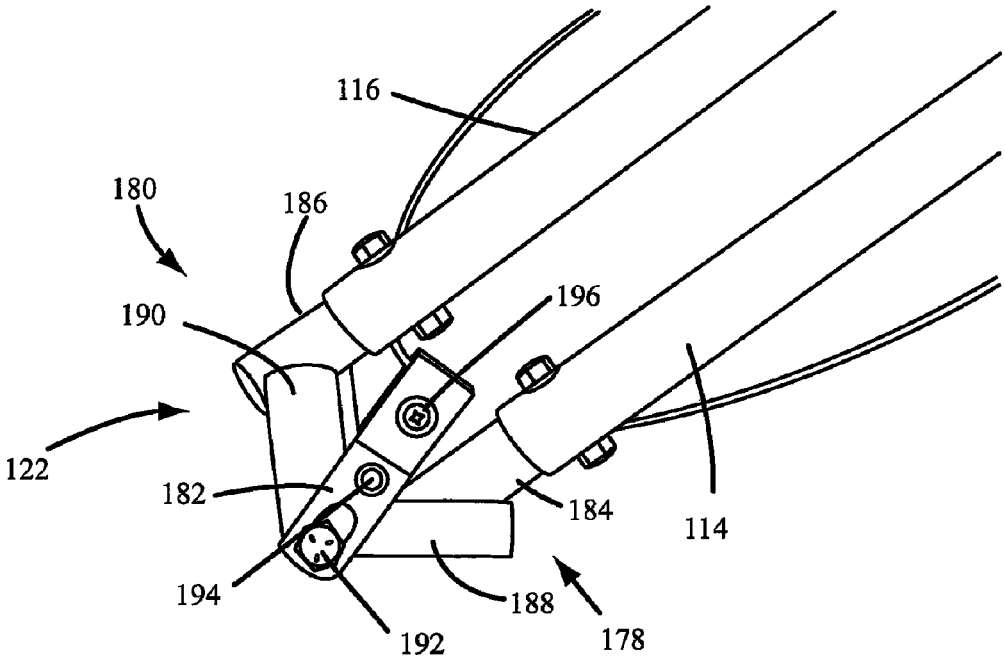
FIG. 18 is a detailed view of a hinge in a collapsed position according to certain embodiments.

Referring now to FIG. 18, a collapsed view of a hinge 122 is shown. The hinge 122 may include a roof pole portion 178 and a wall pole portion 180 as well as a cable extension arm 182. As shown, the roof pole portion 178 and the wall pole portion 180 include a tubular portion 184,186 extending within their respective poles. The roof pole portion 178 may further include a solid bar portion 188 extending diagonally from the tubular portion 184. The wall pole portion 180 may further include a pair of bars or plates 190 also extending diagonally from the tubular portion 186 and spaced to sandwich the solid bar portion 188 of the roof pole portion 178 between them. The solid bar 188 and the pair of plates 190 may be connected with a hinge pin 192 near their ends opposite their attachment to their respective tubular portions 184, 186. It is noted that this type of attachment causes the hinge pin 192 to be in a double shear condition providing for a relatively strong connection as opposed to a single shear condition. The hinge pin 192 may be a bolt or may be some other pin known in the art. The tubular portion 184 of the roof pole portion 178 and the tubular portion 186 of wall pole portion 180 of the hinge 122 may be anchored in each of the respective poles 114,116 with a through bolt as shown, or a screw, set screw, pin, weld, or other fastening device known in the art. The connection between the tubular portion 184,186 and the solid bar 188 or pair of plates 190 may be a welded connection as shown, or may be any rigid connection known in the art.

Still referring to FIG. 18, the cable extension arm 182 may be adapted to saddle around the hinge 122. The cable extension arm 182 may also have a slotted hole and may be attached to the hinge 122 with the hinge pin 192 passing through the slotted hole. In addition, the cable extension arm 182 may include a rigidly attached pin 194 passing across its saddle portion. The cable extension arm 182 may also be adapted to receive the cable 120. The cable 120 may enter the cable extension arm 182 at the outer most edge opposite that of the slotted hole. The cable 120 may be received in the cable extension arm 182 and the cable 120 may have a steel ball stop permanently pressed over it. The cable extension arm 182 may include a cable bushing to receive the steel ball preventing the cable from sliding in or out of the cable extension arm 182. The cable extension arm 182 may also have a male portion of a snap 196 on one side or each side for button attachment of a strap from the shell portion 104 of the tent 100. The snap 196 may include a screw or bolt which in turn also anchors the cable bushing within the cable extension arm 182.

Figure 19:
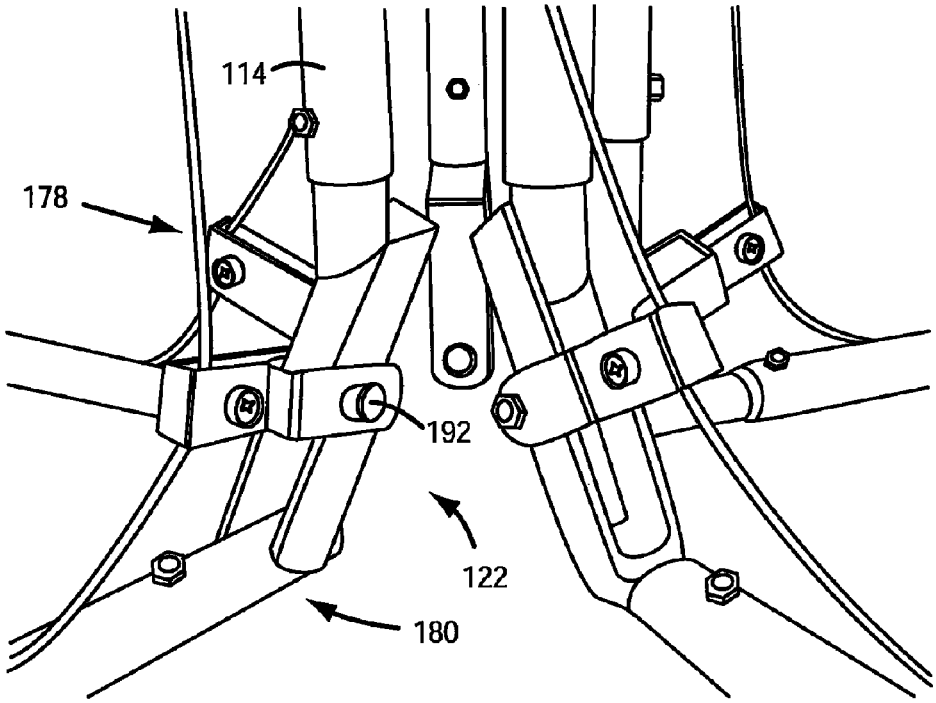
FIG. 19 is a detailed view of a hinge in a partially expanded position according to certain embodiments.
Figure 20:
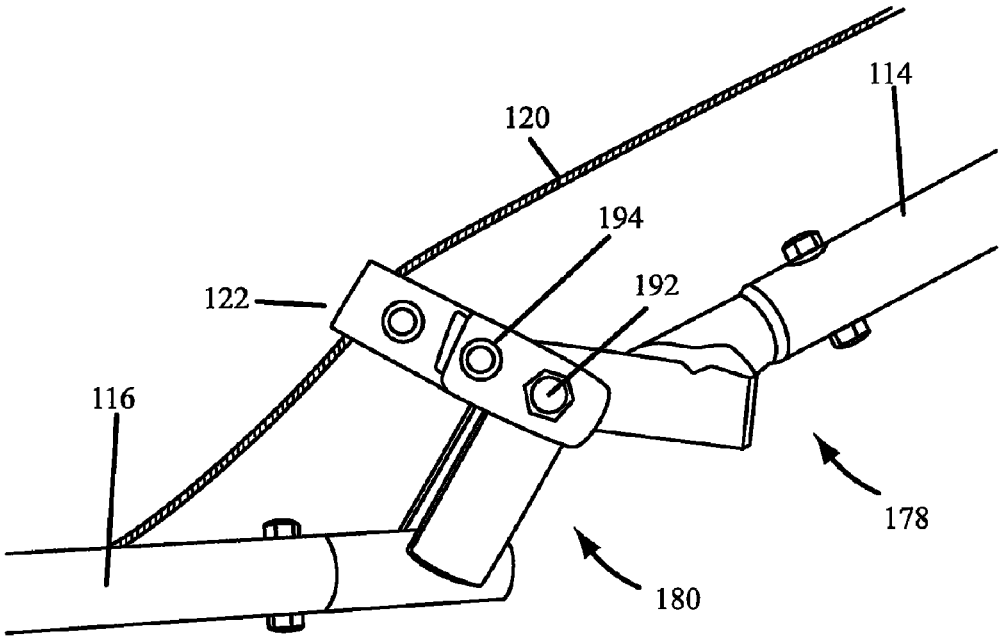
FIG. 20 is a detailed view of a hinge in a partially expanded position according to certain embodiments.
Figure 21:
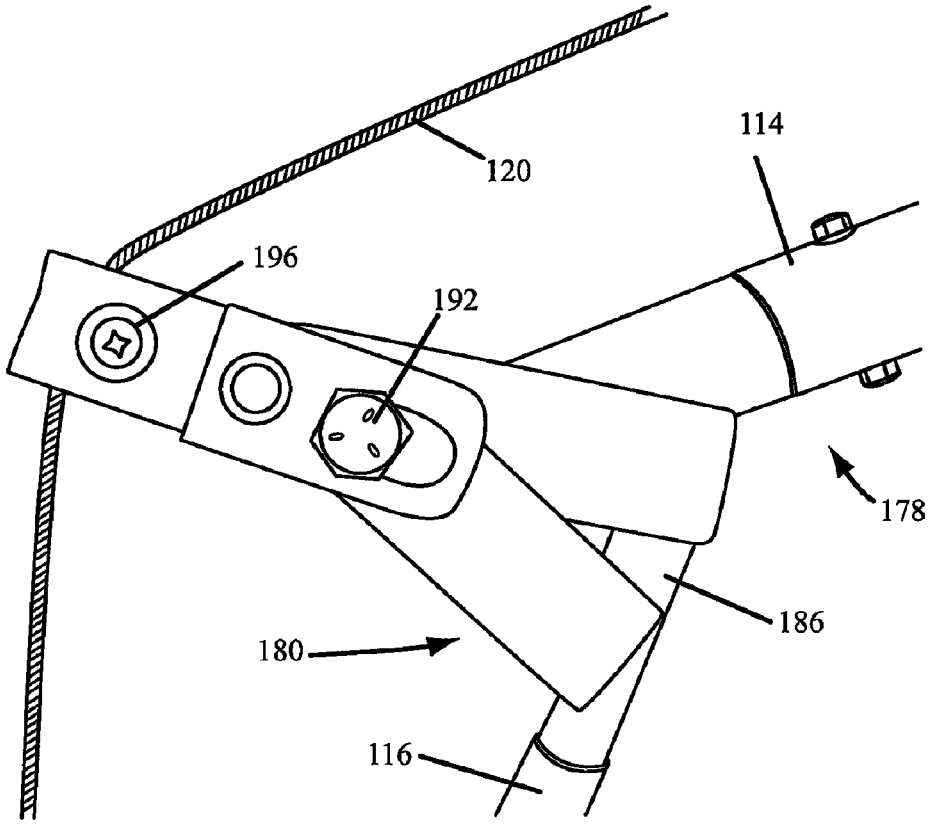
FIG. 21 is a detailed view of a hinge in a fully expanded position according to certain embodiments.

Referring now to FIGS. 19 and 20, a partially expanded view of a hinge 122 is shown. In comparing the FIGS. 19 and 20 to FIG. 18, it can be seen that the roof pole portion 178 and wall pole portion 180 of the hinge 122 may allow the roof pole 114 and the wall pole 116 to rotate about the hinge pin 192 relative to each other within a certain range. That is, starting from the collapsed position shown in FIG. 18, the roof pole 114 and the wall pole 116 may be substantially parallel. As the frame is expanded, the roof pole 114 and the wall pole 116 may be free to rotate until they reach the position shown in FIG. 21, reflecting a range of approximately 210 degrees to approximately 260 degrees. In one embodiment, the roof pole 114 and the wall pole 116 may be rotated approximately 235 degrees relative to each other. When the position of FIG. 21 is reached, the tubular portion 186 of the wall pole portion 180 of the hinge 122 may abut against the side of the roof pole portion 178 preventing further rotation and the included interior angle between the roof pole 114 and the wall pole 116 may be from approximately 110 degrees to approximately 140 degrees. In one embodiment, the included interior angle may be approximately 125 degrees.

Figure 22:
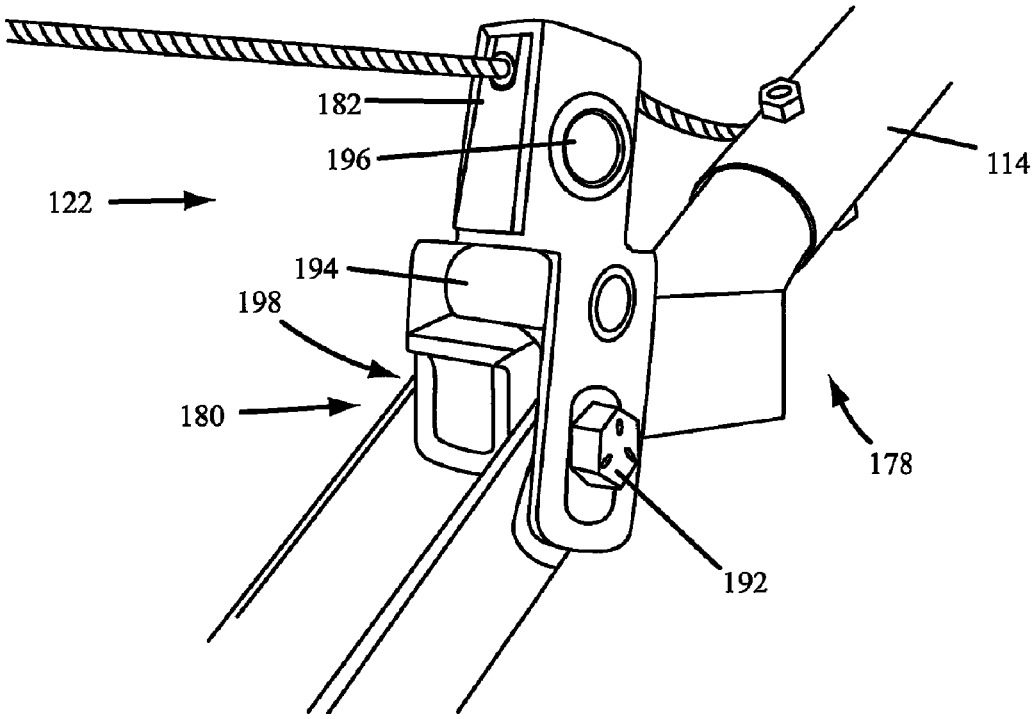
FIG. 22 is a detailed view of a hinge revealing a concave end of a portion of a hinge according to certain embodiments.

Referring now to FIG. 22, the position and effect of the cable extension arm 182 may be seen. The toe end of the roof pole portion 178 of the hinge 122 may include a concave receiving portion 198 adapted to receive the rigidly attached pin 194 of the cable extension arm 182. Additionally, the slotted hole in the cable extension arm 182 allows the cable extension arm 182 to slide inward and outward allowing the rigidly attached pin 194 to pass beyond the outer tip of the concave receiving portion 198. When the crank assembly 156 at the top of the frame 102 is used to tension the cables 120, those of skill in the art will understand and appreciate that the cable extension arm 182 will be forced inward, causing the cable extension arm 192 to slide along the hinge pin 192 via its slotted hole, thus engaging the rigidly attached pin 194 of the cable extension arm 182 in the concave receiving portion 198 of the roof pole portion 178 of the hinge 122. Once positioned, the rigidly attached pin 194 seated in the concave receiving portion 198 acts to prevent the cable extension arm 182 from rotating out of position under the compressive force of the cable 120 passing across it. That is, once in position with tension on the cable 120, one way to fold the cable extension arm 182 back, as shown in FIG. 22, is to release the cable tension, which a user would not likely do unless they were intending on collapsing the tent 100. Alternatively, the wall pole 116 could be folded upward to cause the wall pole portion 180 of the hinge 122 to push on and force the rigidly attached pin 194 from its seat in the concave receiving portion 198. However, when the shell 104 of the tent 100 is in place, a circumferential barrier to this type of motion is provided and folding the wall pole 116 in this manner is not feasible.

Figure 23:
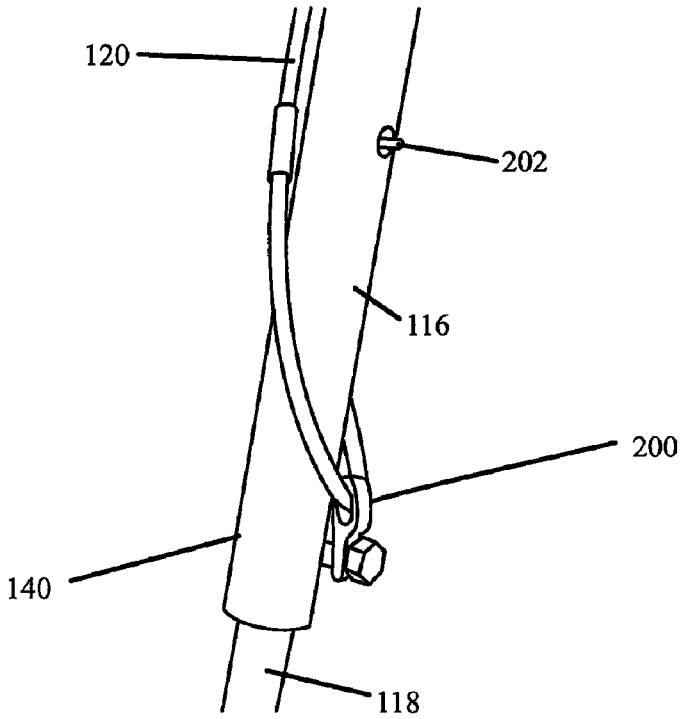
FIG. 23 is a detailed view of a spring ball and an attachment between a wall pole and a cable.

As shown more clearly in FIG. 23, the cable 120 may extend down the length of the wall pole 116 and be secured to the sleeve end 140 of the wall pole 116 with a loop connection similar to that included at the cable hub 126 at the top of the frame 102. Here, however, the loop may pass through a looped plate 200 which is secured with a bolt inserted into a threaded hole in the wall pole 116.

In further reference to the stability of the cable extension arm 182, the length of the cable 120 between the attachment of the cable 120 to the sleeve end 140 of the wall pole 116 and the secured attachment to the cable extension arm 182 defines a predetermined distance. Thus, when the frame 102 is expanded, the predetermined length of the cable 120 between the sleeve end 140 of the wall pole 116 and the cable extension arm 182 naturally causes the cable extension arm 182 to be positioned as shown in FIG. 21 and prevents the cable extension arm 182 from rotating up past the concave receiving portion 198.

Referring back to FIG. 23, a spring ball 202 is shown projecting through a hole in the wall pole 116. The spring ball 202 is positioned on the telescoping rod 118 such that when the telescoping rod 118 is extended out of the end of the wall pole 116, the spring ball 202 snaps into place in the hole shown preventing additional outward movement of the telescoping rod 118 and also preventing inward movement of the telescoping rod 118. Information regarding an alternative spring ball embodiment, may be found in FIG. 77 or 78.

Figure 24:
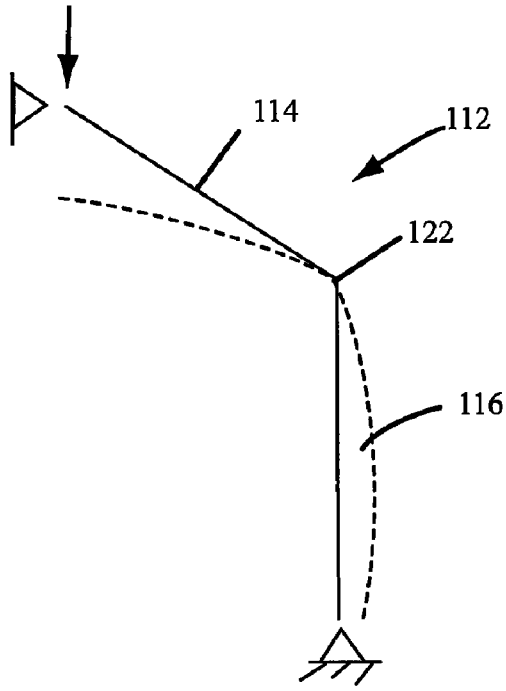
FIG. 24 is a view of the deflected shape of a support leg without the truss system in place according to certain embodiments.

It is noted here that the truss action of the embodiment described may be very efficient. As shown in FIG. 24, a support leg 112 system without a tension cable 120 is shown. When such a support leg 112 is loaded from above, the geometry of the support leg 112 may cause the hinge 122 to tend toward collapsing. However, as discussed with respect to FIGS. 19 and 20, the geometry of the hinge 122 may prevent relative rotation in that direction and thus may act as a rigid connection between the roof pole 114 and the wall pole 116. As such, no relative rotation may be allowed between the roof pole 114 and the wall pole 116 and the support leg 112 may act as a continuous member with a bent shape. Thus, the deflected shape shown in FIG. 24 may result (exaggerated for purposes of explanation).

Figure 25:
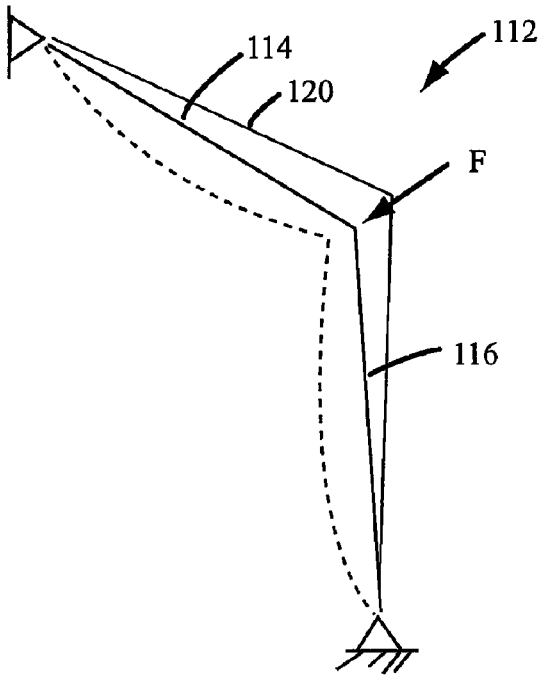
FIG. 25 is a view of the deflected shape of a support leg with only the truss system forces in place according to certain embodiments.

When a truss system is applied to the same leg system, a strut in the form of a cable extension arm 182 or other member may create a lateral force to the hinge location due to the tension in the cable 120 passing over the strut. As shown, this lateral force may induce a bending moment in the frame 102 opposite that caused by loading the structure. As such, the effect of the truss system may be to cause a deflected shape as shown in FIG. 25 (exaggerated for purposes of explanation).

The net result may be a truss system with internal forces that are opposite to that of loading the structure. Thus, when loaded, the deflected shapes of FIGS. 24 and 25 may counteract each other to create a frame 102 with compression members showing little or no bending deflection, the compression members being the roof poles 114 and wall poles 116 and the tension member being the cable 120. As such, the capacity and strength of the frame 102 may become more dependent on the compressive strength of the wall and roof poles 114,116 and the tensile strength of the cable 120 rather than the bending strength of the tall slender poles, 114,116. This may create a much stronger system than if the truss system were omitted.

Figure 26:
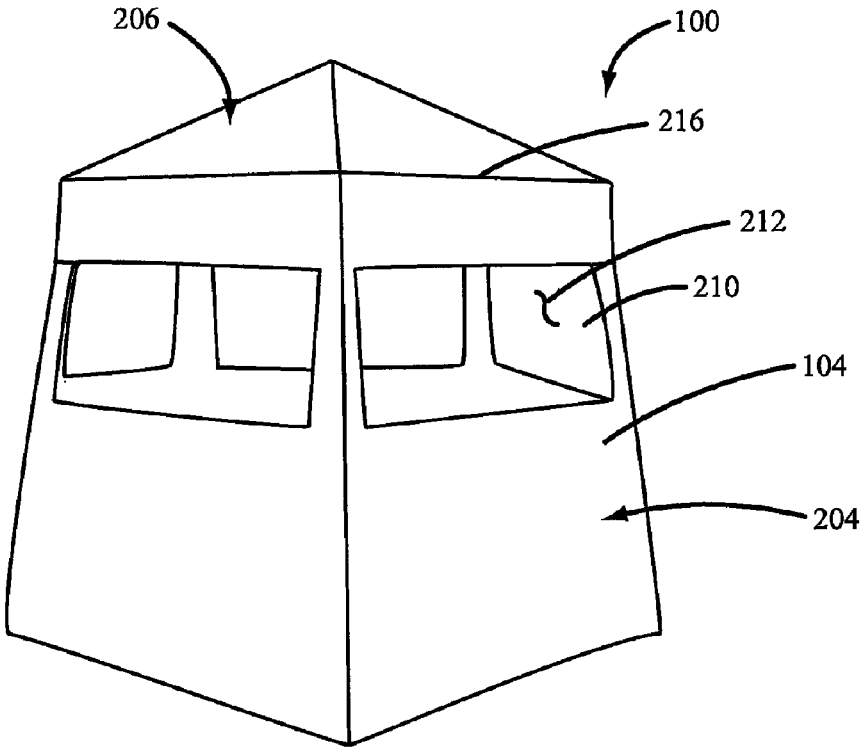
FIG. 26 is a view of a tent shell according to certain embodiments.
Figure 27:
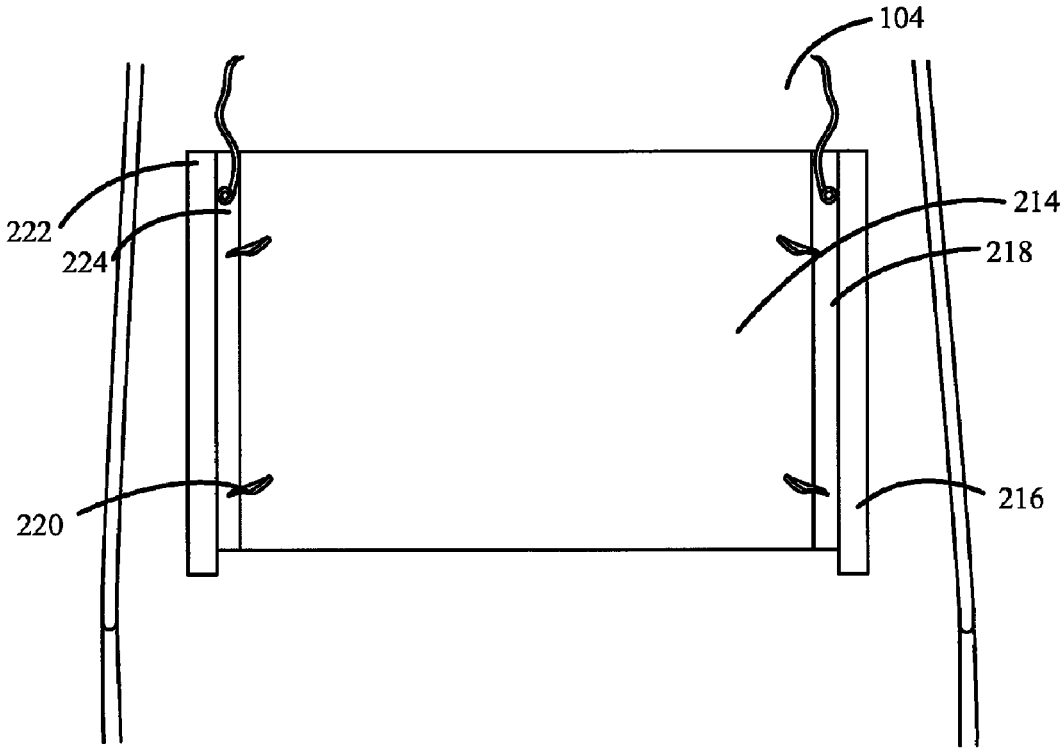
FIG. 27 is an interior view of a window opening with a window curtain in a fully closed position according to certain embodiments.

Referring to FIG. 26, a tent 100 with a shell 104 is shown according to certain embodiments. The tent 100 and associated shell 104 may have walls 204 and an associated roof 206. The shell 104 of the tent 100 may or may not have a bottom 208. Alternatively, it may simply have a partial bottom 208 around the perimeter of the tent. The tent shell 104 may be adapted to fit over a frame 102 similar to that previously described. As such, the shell 104 of the tent 100 may be adapted to rest on the cables 120 of the frame 102 as the cables 120 define the outer most portions of the frame 102.

As shown in FIG. 26, the tent 100 may have window openings 210 in any or all of the walls 204. The windows 210 may extend substantially all the way across the shell wall 204 and may be located in the upper half of the wall height. The window openings 210 may include a window screen 212 and a window curtain 214 (not shown). Additionally, the shell 104 of the tent 100 may include peep holes 216 (shown closed) for viewing outside of the tent 100 when a window curtain 214 in a particular direction may not be open. The shell 104 of the tent 100 may be made from a variety of material including but not limited to canvas, vinyl, or other textiles known to resist wind, rain, and other natural elements. The shell 104 may be camouflage and the window screens 212 may also be camouflage while the window curtain 214 may be a solid color creating a background for the screen camouflage. Alternatively, the screens 212 may be a regular screen color and the window curtain 214 may be camouflage. Alternatively, both the window screen 212 and the window curtain 214 may be camouflage. In still another embodiment, the window curtains 214 may be clear see through vinyl. Connections to and from the shell 104 may take several forms and may include sewed connections, glued or adhered connections. Connections may also take the form of a hole in the shell 104 reinforced with a grommet. Other connections will be apparent to those skilled in the art.

Referring now to FIGS. 27-30, a vertically slidable window curtain 214 is shown. The window curtain 214 may be made of the same or similar material as the shell 104. The tent shell 104 may have shell channels 216 affixed to the edges of the window openings 210 for receiving the a corresponding curtain channel 218 affixed to the vertical edges of the window curtains 214. The window curtain may also have pull tabs 220 in each of the corners of the window curtain 214 for sliding the window curtain 214 up and down.

Figure 28:
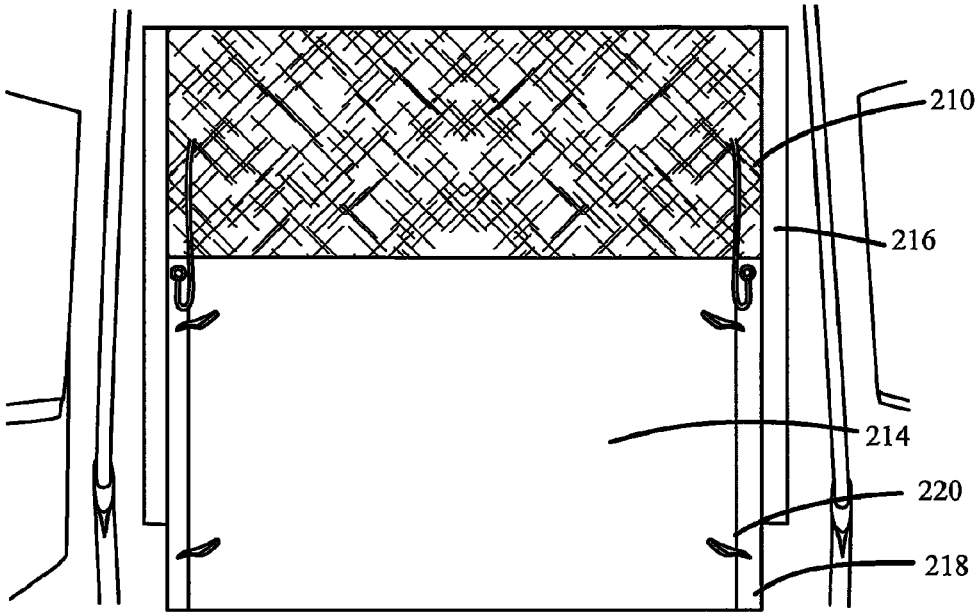
FIG. 28 is an interior view of a window opening with a window curtain in a partially open position according to certain embodiments.
Figure 29:
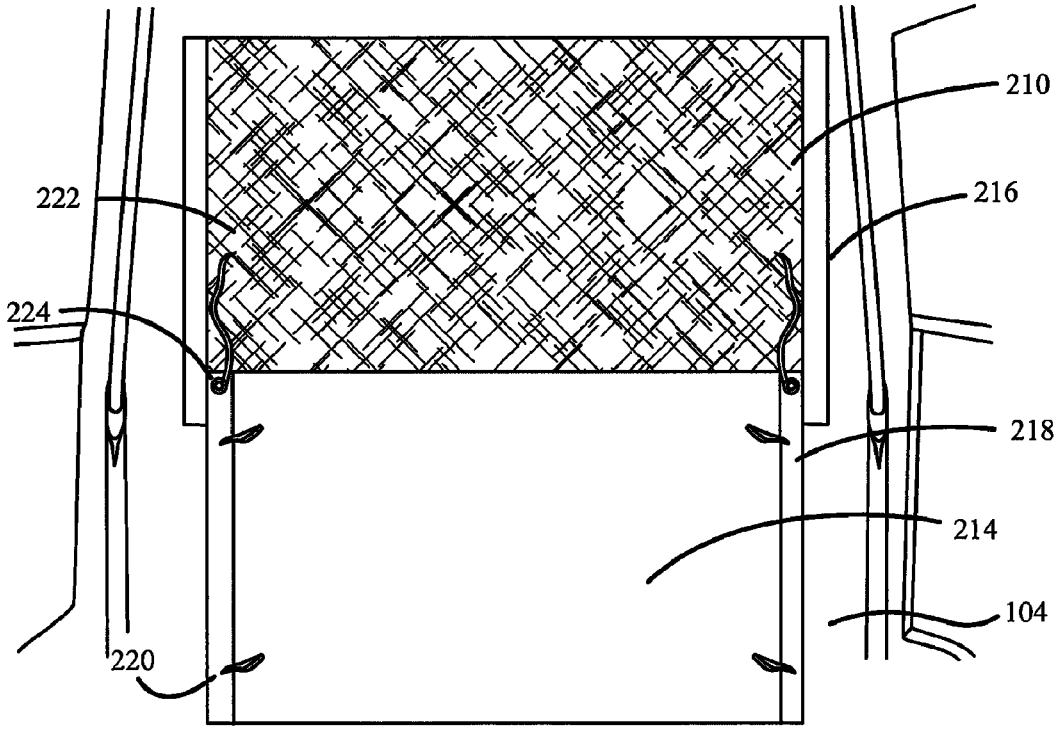
FIG. 29 is an interior view of a window opening with a window curtain in a fully open position according to certain embodiments.
Figure 30:
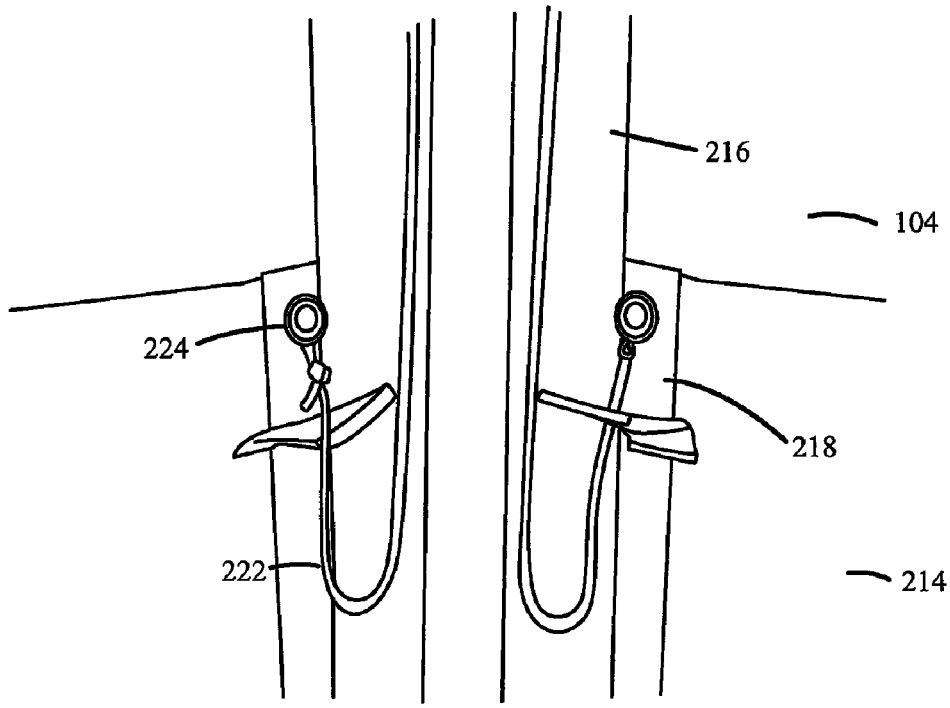
FIG. 30 is a interior close up view of two rope knobs in the upper corners of window curtains according to certain embodiments.
Figure 31:
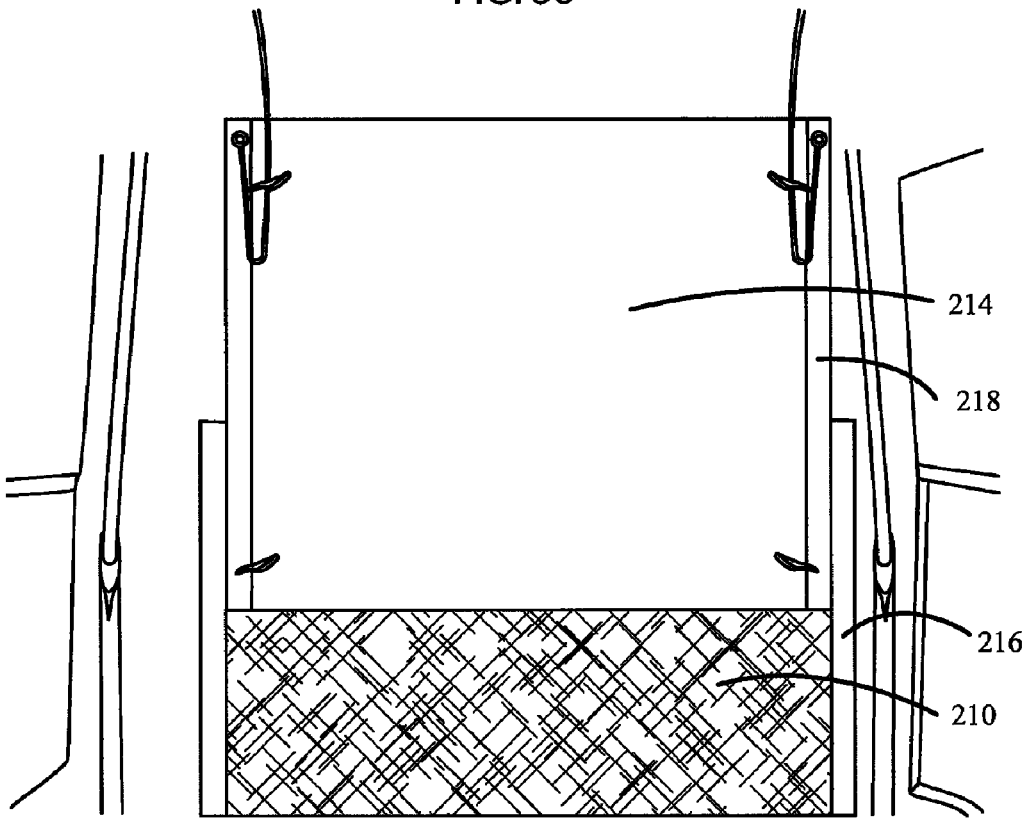
FIG. 31 is a interior view of a window opening with a window curtain in a partially open position according to certain embodiments.

As can be seen in FIGS. 28 and 29, the pull tabs 220 in the bottom corners of the window curtain 214 may be pulled on to slide the window curtain 214 downward causing the window opening 210 to be exposed above the curtain 214 and also causing the window curtain 214 to lap along the inside face of the shell 104 below the window opening 210. FIG. 28 shows the window curtain 214 pulled partially open and FIG. 29 shows the window curtain 214 pulled fully open. To prevent the window curtain from continuing to slide downward or to provide a stopping point for the window curtain 214, a rope 222 may be fastened to the tent 100 and further fastened to a rope knob 224 in the upper corners of the window curtain 214 as shown in FIG. 30. The rope 222 may have a length and may be fastened to the tent 100 in a location so as to prevent the window curtain 214 from moving downward beyond the length of the shell channel 216. Referring back to FIG. 29, the curtain channel 218 and the shell channel 216 may maintain an overlap of approximately an inch or more. In another embodiment, the shell channel 216 extends 12" to 18" down beyond the bottom of the window opening 210. In this embodiment, the rope 222 and rope knob 224 may not be necessary as the overlap of the curtain channel 218 maintains sufficient overlap with the shell channel 216 to avoid falling out the bottom of the shell channel 216. This maintains the window curtain 214 closer to the inside face of the shell 104 and prevents excess flapping and noise. As can be seen in FIG. 31, the vertical sliding window curtain 214 may also be slid upward by grasping the pull tabs 220 in the upper corners of the window curtain 214 and pulling up on the window curtain 214.

Figure 32A:
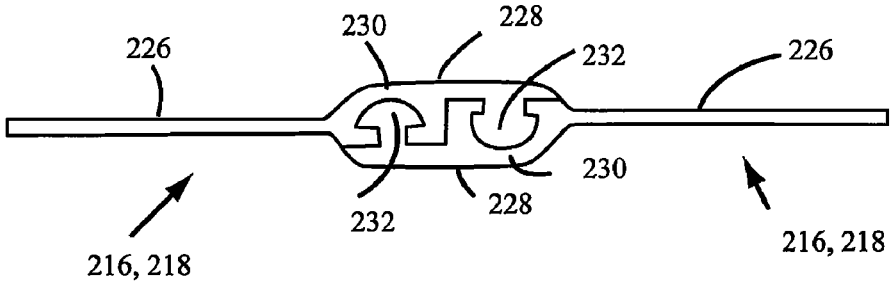
FIG. 32A is a cross section view of interlocking window channels according to certain embodiments.
Figure 32B:
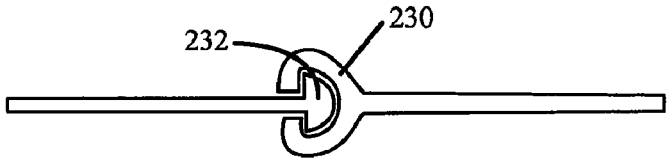
FIG. 32B is a cross section view of interlocking window channels according to certain embodiments.

For a detailed discussion of the shell channel 216 and the curtain channel 218, reference is now made to FIG. 32A. FIG. 32A is a cross section view of a shell and curtain channel 216,218 in slidable mated position. As shown, the shell channel 216 and the curtain channel 218 may be identical reversible pieces to cut down on manufacturing costs. Alternatively, they may not be identical. The channels 216,218 may be made from flexible plastic material and may fit together with sufficient snugness to prevent the window curtain 214 from sliding inadvertently but sufficient looseness to allow the window curtain 214 to slide readily when the pull tabs 220 are pulled on. As shown in FIG. 32A, the channels 216,218 may have a tab portion 226 for sewing or otherwise adhering to the tent shell 104 or the window curtain 214. The channels 216,218 may also have an interlocking portion 228 including a female receiving portion 230 and a male portion 232 adapted to allow relative longitudinal movement between the two channels 216,218 but not relative transverse movement in any direction. In a more simplified version, as shown in FIG. 32B, one of the channels 216, 218 has only a female receiving portion 230 and the other channel has only a male portion 232 allowing the two channels 216,218 to be interlocked with a slidable relationship.

Figure 33A:
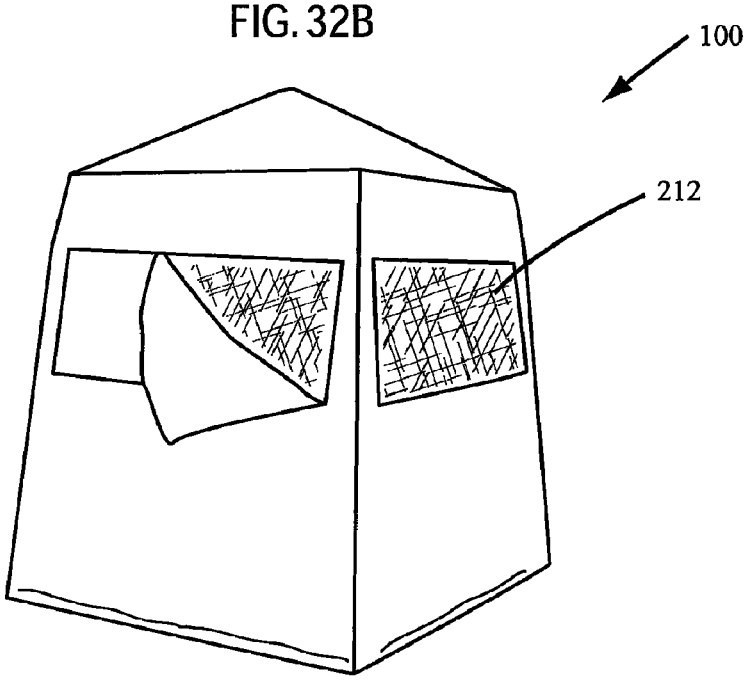
FIG. 33 is an exterior view of a tent shell showing a removable screen according to certain embodiments.
Figure 33B:
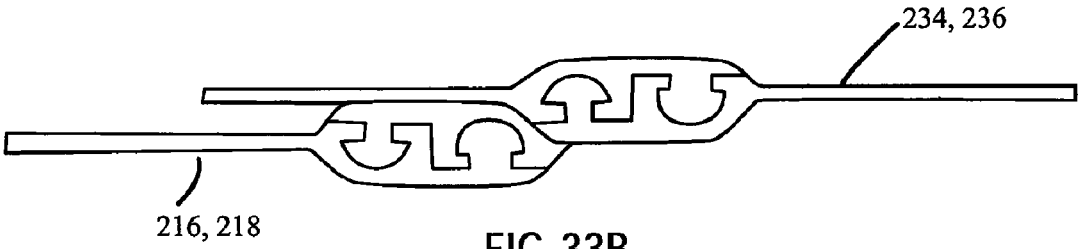
Figure 91:
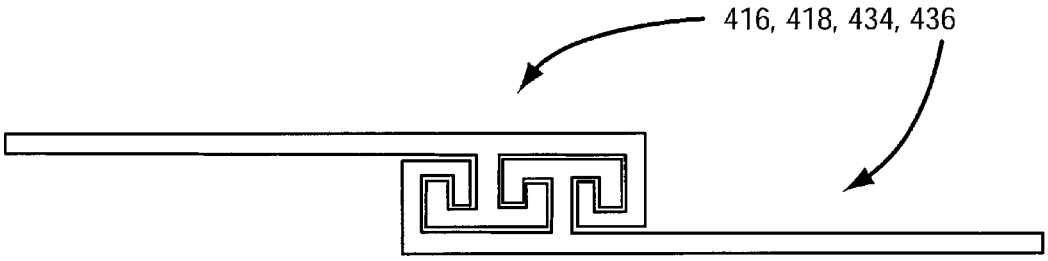
FIG. 91 is a view of an another embodiment for a window/screen channel system, according to certain embodiments.

Referring now to FIG. 33A, an exterior view of a tent 100 is shown. As can be seen from the FIG. 33A, the screens 212 are camouflage screens and are removable. The screens 212 may be attached to the window opening in a similar manner to that of a window curtain 214. That is, the screen 212 may have a screen channel 236 sewn to its edge similar to that shown in FIG. 32A and the shell 104 may have a corresponding shell channel 234 sewn to the edge of the window opening 210 similar to FIG. 32A. As such, the screen 212 may slide up and down in a similar fashion as the window curtain 214. As shown in FIG. 33B, the window channels 216,218 and the screen channels 234,236 may be nested next to each other to provide for the movement of both the window curtain 214 and the screen 212 separately or together. Alternatively, the channel affixed to the shell 104 may simply have two sets of channels: one for receiving the window curtain 214 and one for receiving the screen 212. Alternatively, the screens 212 may be secured with hook and loop and may be removed prior to beginning hunting, photography, or some other activity where quiet removal is required. In another embodiment shown in FIG. 91, an alternative geometry of the channels described is shown. This geometry could be used as a shell channel 416, 434 or a window curtain/screen channel 418, 436.

Figure 34:
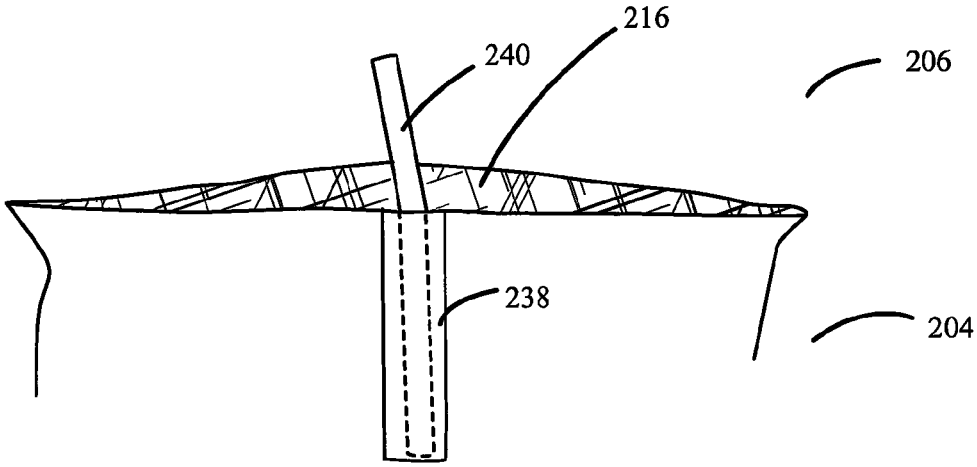
FIG. 34 is an interior view of a peek/vent hole in a close position according to certain embodiments.
Figure 35:
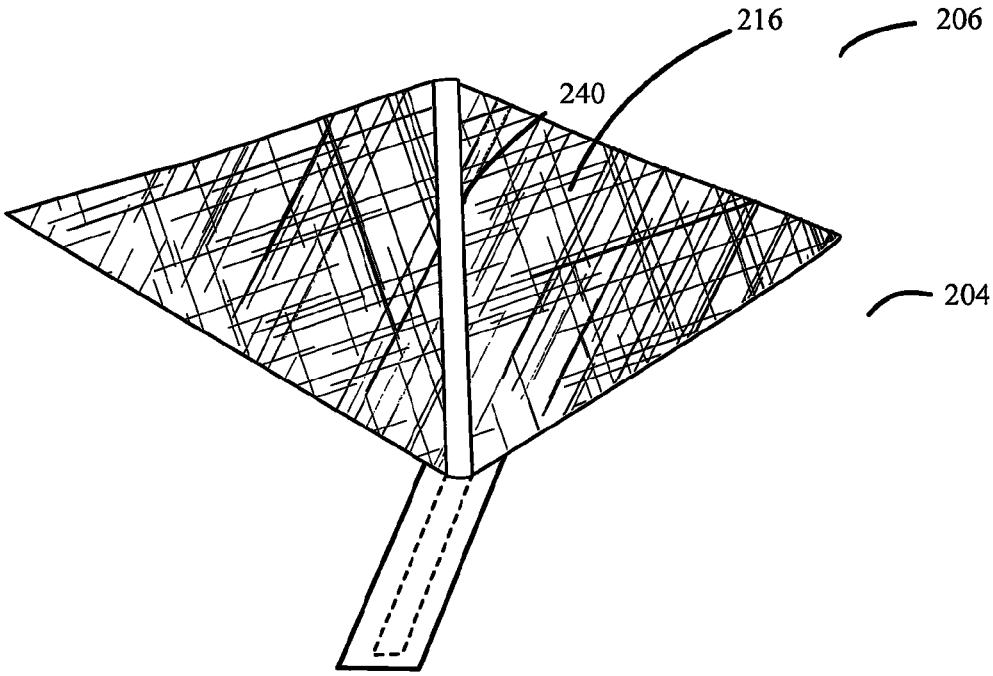
FIG. 35 is an interior view of a peek/vent hole in an open position according to certain embodiments.

Referring now to FIGS. 34 and 35, the tent shell may include collapsible/expandable peek/vent holes 216 for viewing outside the tent 100 or allowing air to flow in and out of the tent 100 when the window curtains 214 are closed. As shown, the peek holes 216 may be near the seam between the wall portion 204 and the roof portion 206 of the shell 104 and may be located toward the middle of the width of the wall 204. As additionally shown in FIG. 34, a fabric sleeve 238 may be sewn to the inside face of the shell just below the peek hole 216 opening. A holder 240 with a bottom portion, an upper portion, and a plastic hinge may be positioned within the sleeve 238 and may extend up and out of the sleeve 238 such that the hinge portion of the holder 240 is located approximately at the top of the sleeve 238 and the upper portion extends beyond the sleeve 238. The plastic hinge may allow the upper portion to lie substantially flat against the underside of the roof 206.

Referring now to FIG. 35, to open the peek hole 216, the upper portion of the holder 240 may be forced outward and upward causing the hinge of the holder 240 to allow the upper portion to rotate approximately 115 degrees relative to the lower portion of the holder 240 causing a V-shaped holder 240 directed into the interior of the tent 100. The peek hole 216 may take the shape of a diamond and may have a camouflage screen permanently sewn in. The upper most end of the holder 240 may secure itself in the seam between the screen of the peek hole 216 and its attachment to the roof portion 206 of the shell 104. The peek hole 216 may be approximately 16" wide by 4" high. Alternatively it may be larger or smaller.

Referring back to FIG. 1, the peek holes 216 are shown from the outside of the tent 100. It is noted here that the shape of the peek hole 216 and the nature of its support cause it to create an eave on the roof portion 206 of the shell 104 and also cause the screen of the peek hole 216 to be tilted downward below the eave and the portion of the shell 104 below the peek hole 216 to be tilted inward and upward. This allows the eave shape of the roof 206 to protect the peek hole 216 from water entry. Also, the downward directed screen helps prevent water entry and the upward facing portion of the shell 104 below the screen allows for water to run-off away from the opening.

Figure 45:
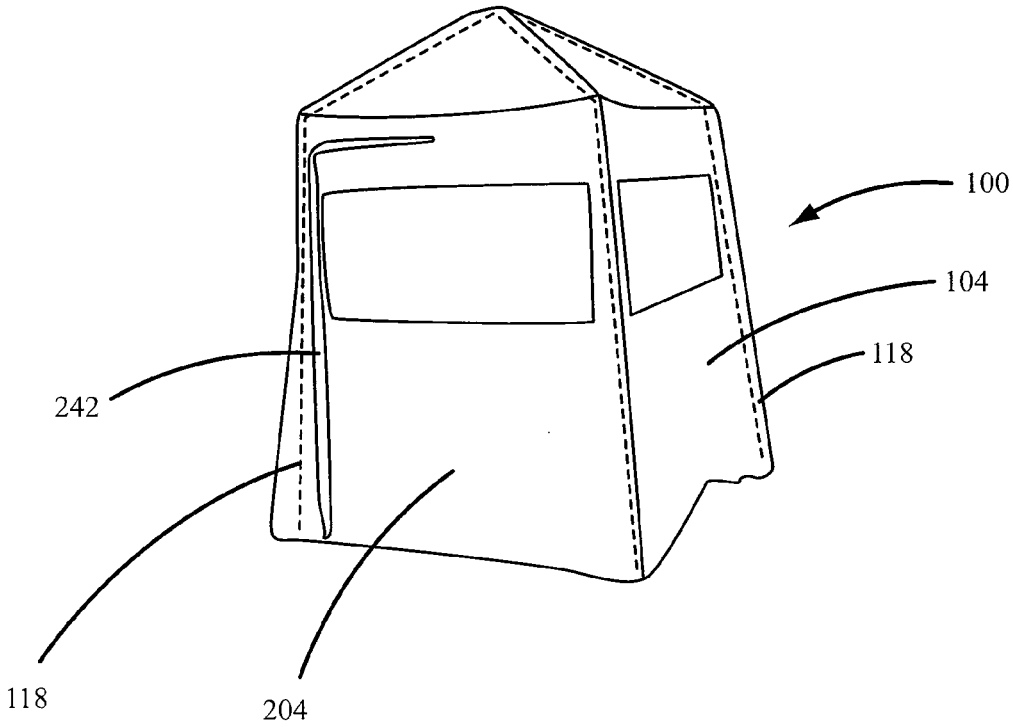

Referring ahead to FIG. 45, the tent may also include a door 242 in the form of a vertical openable seam extending from near the bottom of a tent wall 204 to near the top of a tent wall 204. The seam may also travel laterally across the wall 204 near the top or bottom of the seam or both. The seam may be a secureable seam with hook and loop, a zipper, or other known securing devices. In the case of a zipper, the zipper may be similar to a ziploc baggie with a slidable element that forces a longitudinal male and female element together, thereby providing a relatively quiet process of closing and opening.

Figure 36:
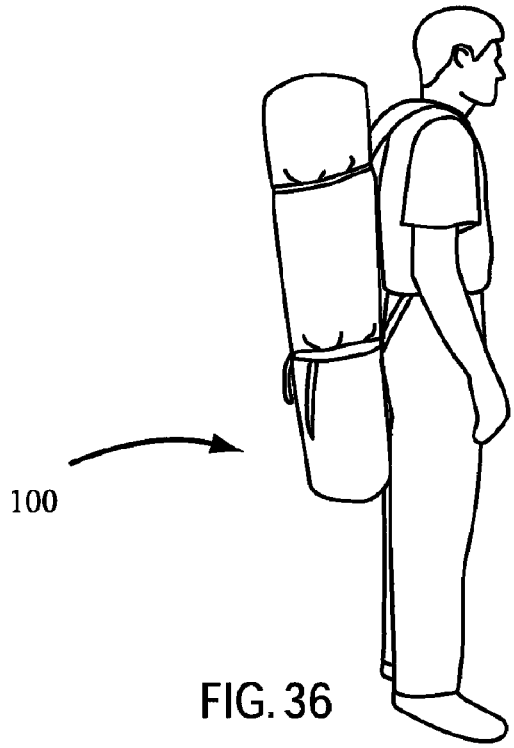
FIG. 36 is a view of a user carrying a portable tent in the form of a backpack according to certain embodiments.

The use and set up of the tent 100 will now be described with respect to FIGS. 36-51. The shell described above may be positioned over the frame 102 and the frame 102 may be in a collapsed position for portability. The collapsed frame 102 and shell 104 may be placed in a bag to form a backpack for even more portability as shown in FIG. 36. This backpack assembly with the collapsed tent 100 included may range from approximately 5 lbs to 30 lbs depending on the size of the tent 100 and the materials used. The size of the collapsed tent 100 may range from approximately 4" in diameter to approximately 18" in diameter and have a length ranging from approximately 24" long to approximately 50" long.

Figure 37:
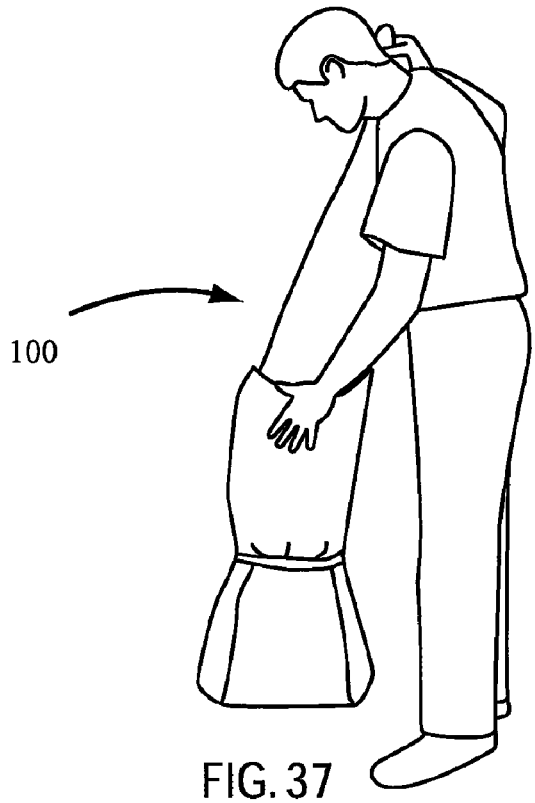
FIGS. 37-46 are individual views of a user in progressive stages of setting up a tent according to certain embodiments.
Figure 38:
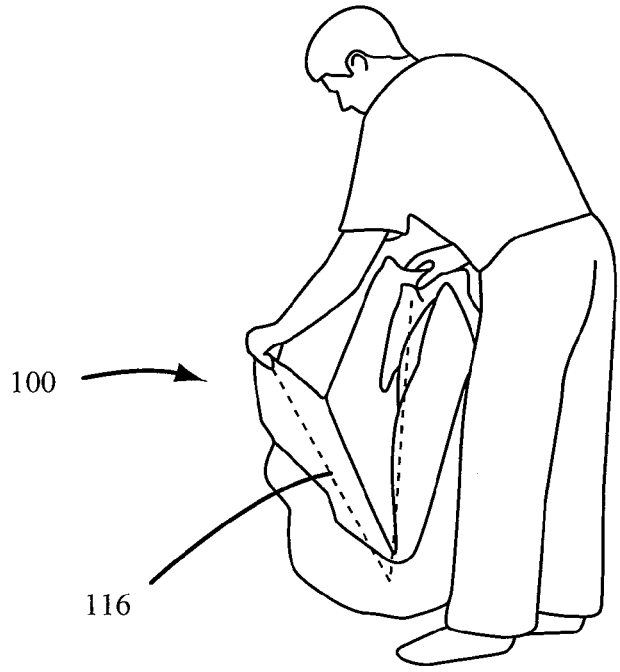
Figure 39:
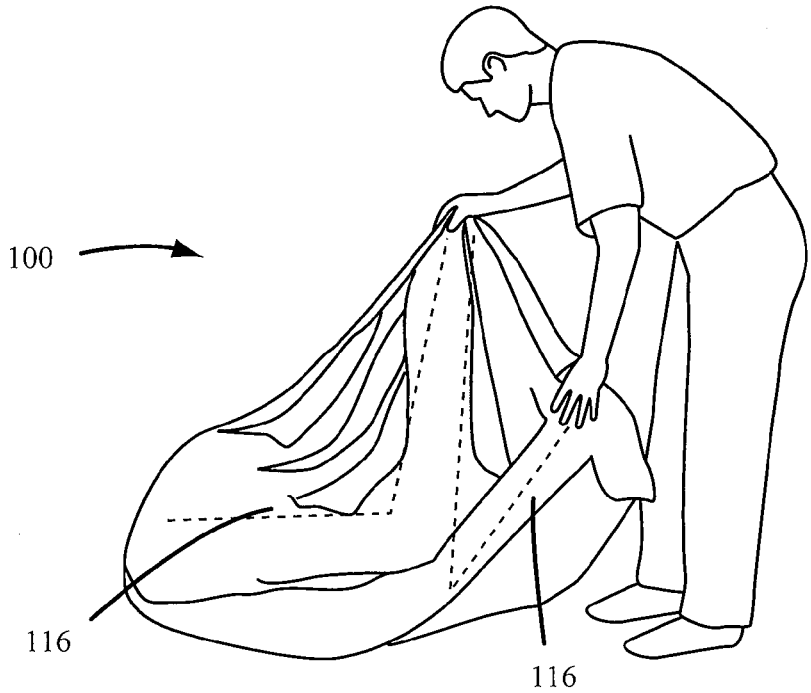
Figure 40:
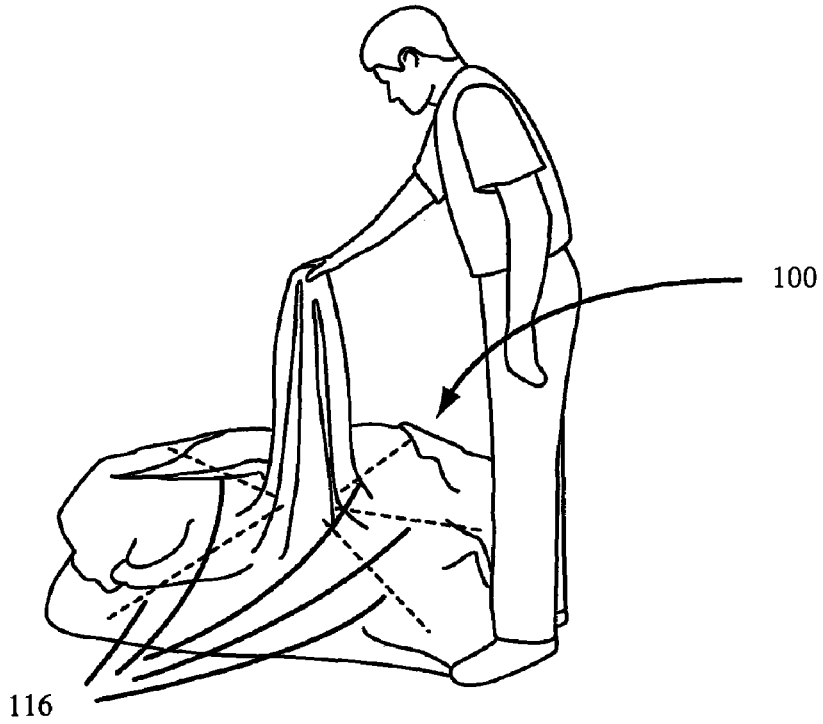
Figure 41:
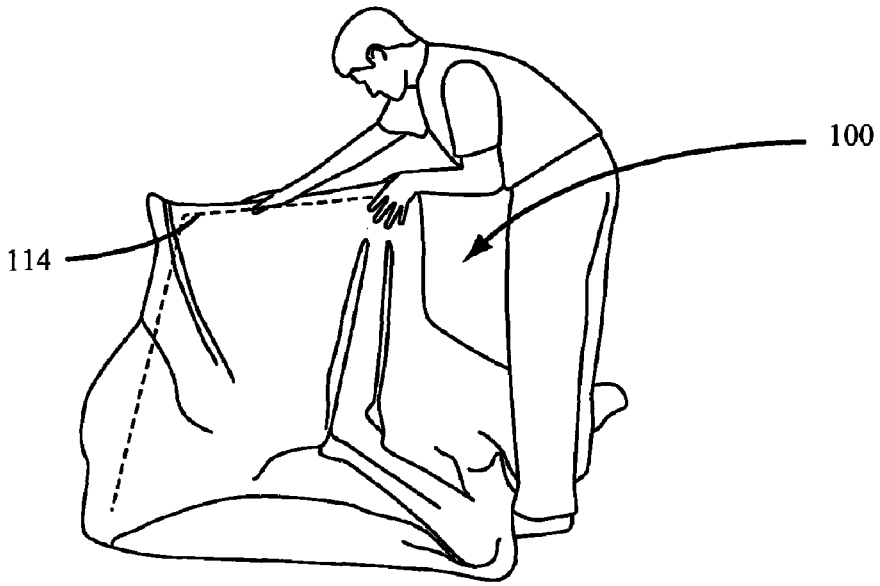
Figure 42:
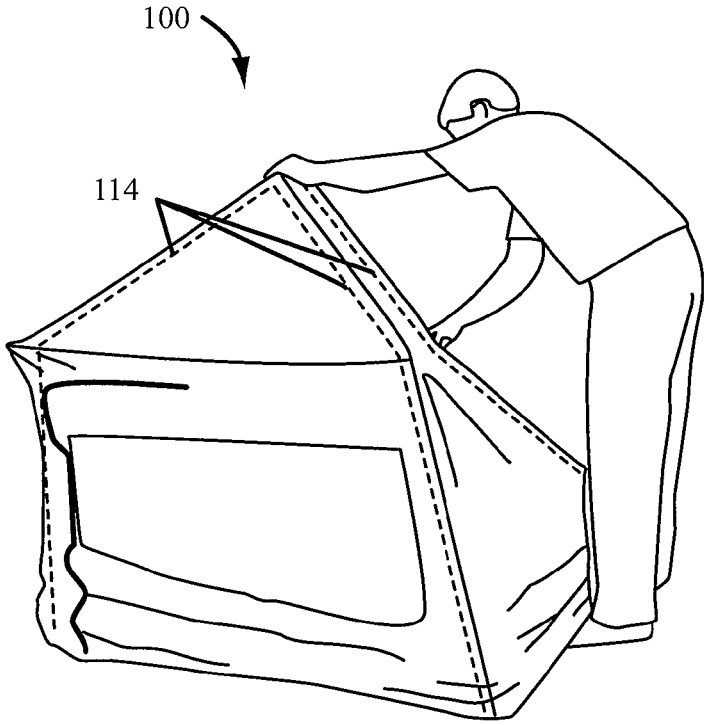
Figure 43:
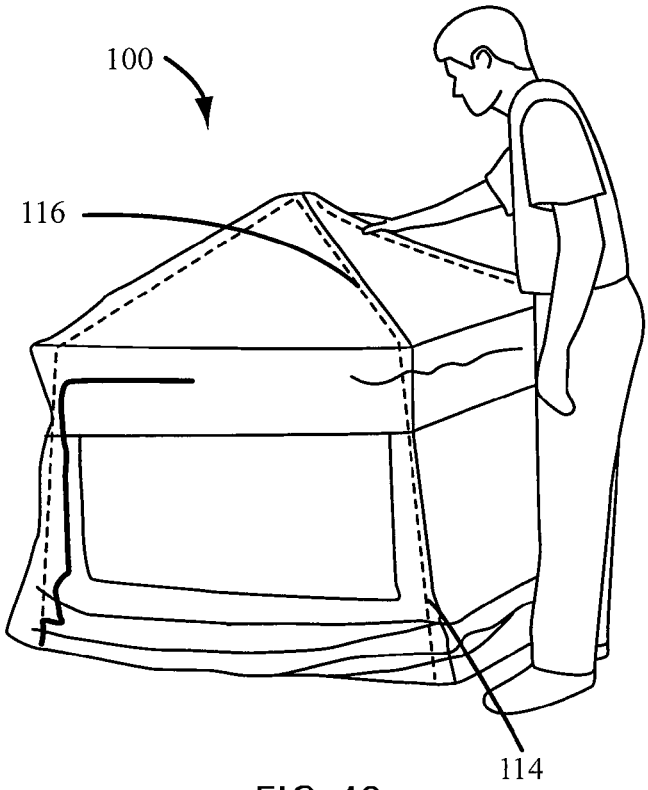
Figure 44:
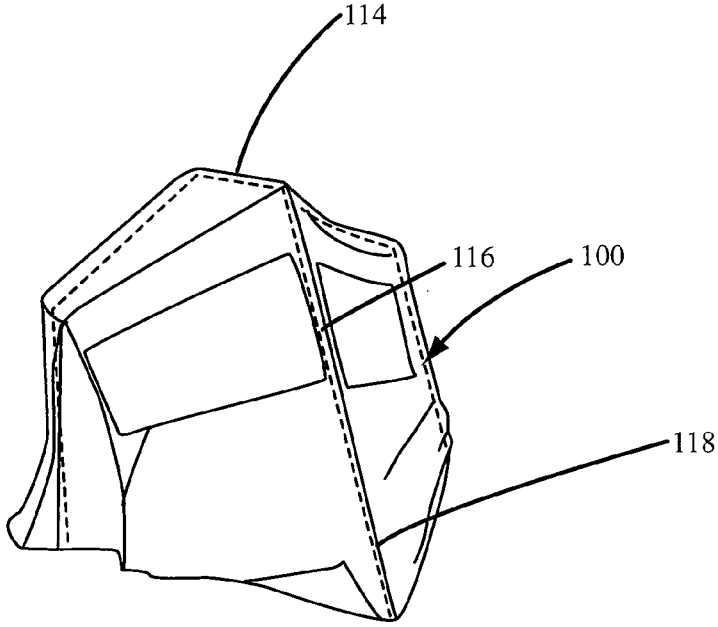
Figure 46:
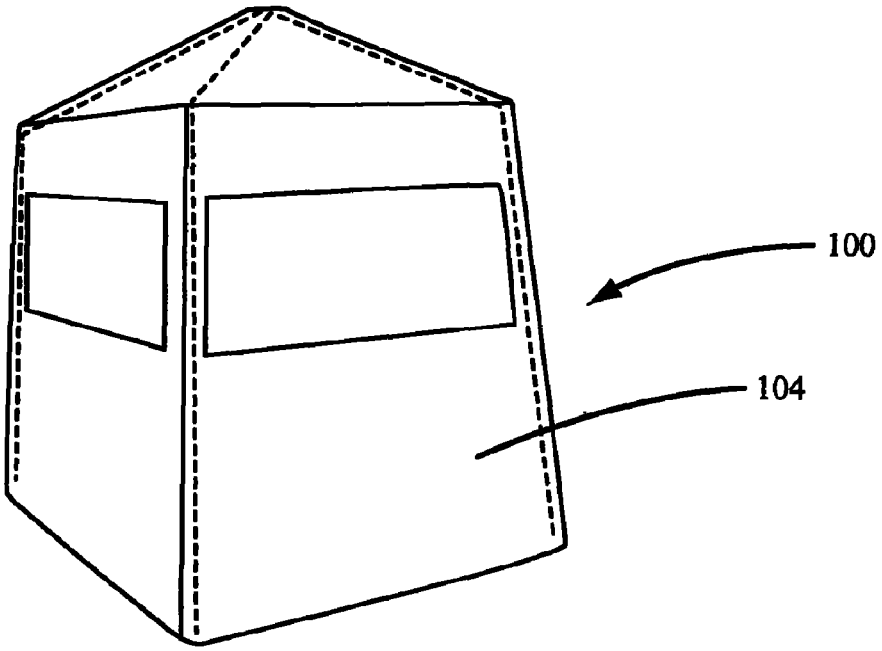
Figure 47:
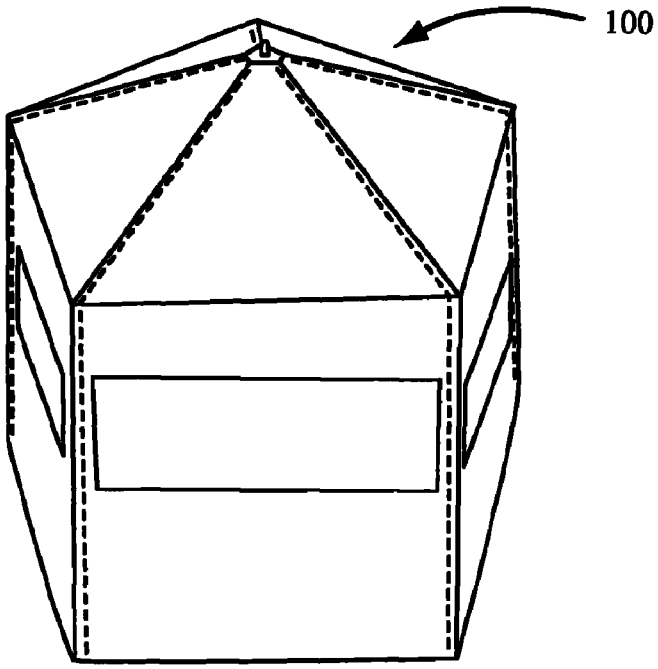
FIGS. 47-51 are several views of a fully set up tent according to certain embodiments.
Figure 48:
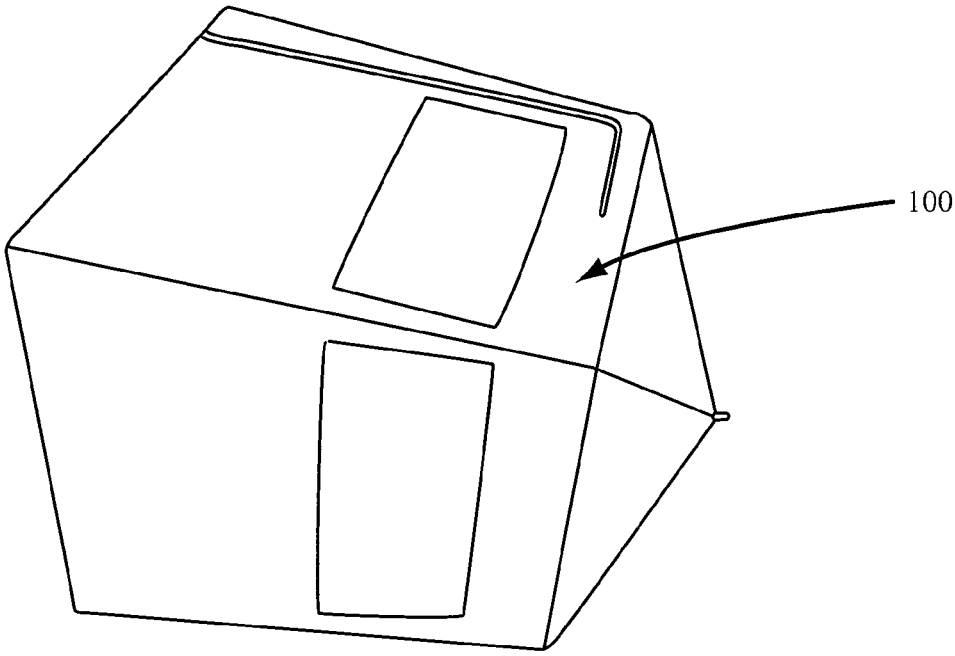
Figure 49:
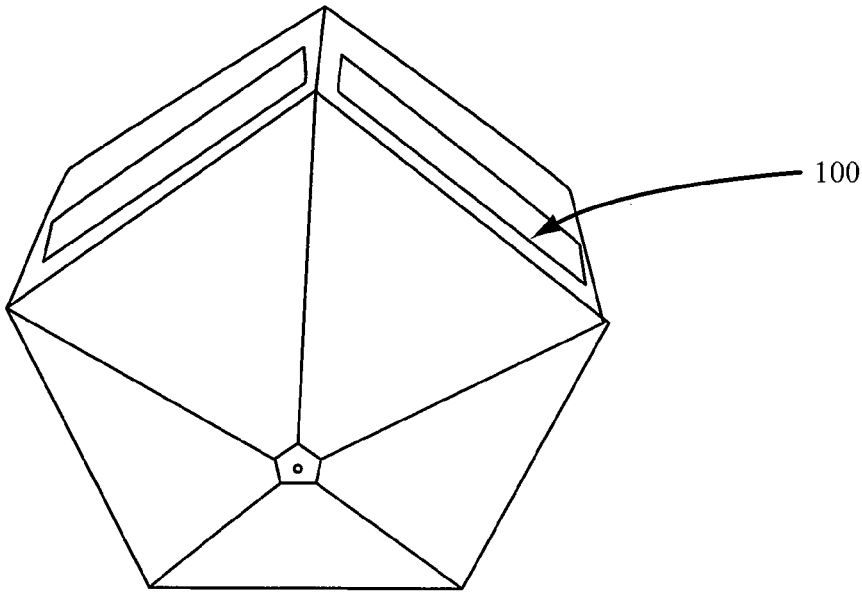
Figure 50:
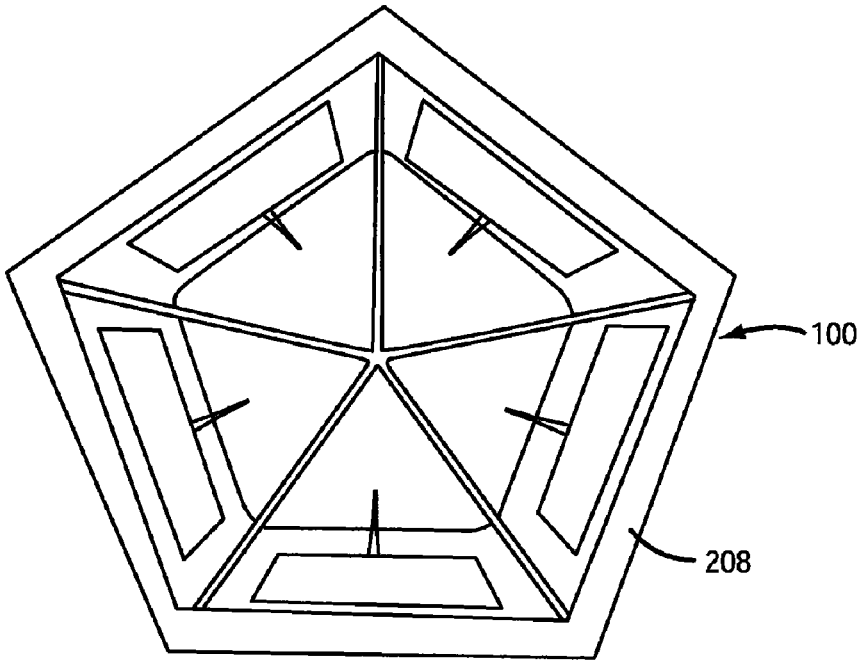
Figure 51:
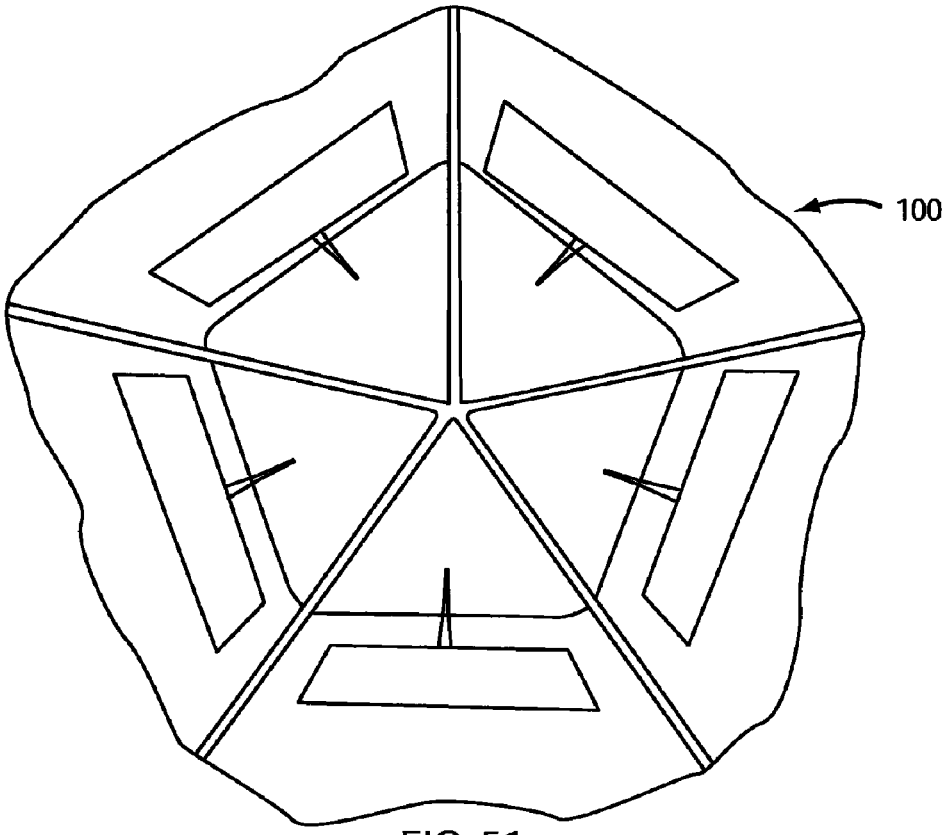

In FIG. 37, the collapsed tent 100 has been removed from the back of the wearer and has been placed on the ground and initial preparations are made. In FIG. 38, the first of five wall poles 116 are being folded down in the same way as that shown in FIG. 10. In FIG. 39, additional wall poles 116 are folded down until all wall poles 116 are folded down as shown in FIG. 40. The next step, as shown in FIG. 41, may include grasping one of the roof poles 114 and pulling it upward to a position similar to that shown in FIG. 11. FIG. 42 shows additional roof poles 114 being pulled upward into position until all roof poles 114 are pulled into position as shown in FIG. 43. At this point, all of the wall poles 116 and roof poles 114 have traveled to their final relative position. Also, the cable extension arm 182 may not yet be seated in the concave receiving portion 198 of the roof pole portion 178 of the hinge 122 as discussed with respect to FIG. 22. However, at this point, an initial amount of tension may be applied to the cables 120 by turning the crank assembly 156 and stabilizing the frame 102 for the remaining steps of set up. This initial tension will begin to engage the cable extension arm 182 in the concave receiving portion 198. FIG. 44 shows the user having entered the tent 100 and extending the first telescoping rod 118 from the bottom of its wall pole 116 similar to that shown in FIG. 14. In FIG. 45, the remaining telescoping rods 118 have been extended. It is noted that at this point, the shell 104 of the tent 100 is positioned over the frame 102 but is relatively loosely positioned. FIG. 46 shows the tent 100 after the crank assembly 156 has been turned causing the cable hub 126 to raise relative to the roof pole hub 124 and create tension in the cables 120 and thus drawing the shell 104 of the tent 100 taut. This is caused by the cable tension causing the frame 102 to extend upward and outward. FIGS. 47-51 show the fully set up tent 100 from various angles and in various positions. In FIG. 48, a partial bottom 208 is shown around the perimeter of the tent 100. Alternatively, a full bottom 208 may be provided. The take down procedure may follow the steps above in the opposite order and variations will be apparent to those skilled in the art.

Those skilled in the art will understand and appreciate that several alternatives are available to the specific embodiments described above. These alternatives are still within the scope of the invention.

For example, the elements of the frame 102 may be constructed of most any material, including but not limited to steel, aluminum, various plastics, or other materials known in the art. For example, the pole members 114, 116,118 may be made from most any type of stiff or flexible pipe, tube, or rod. Additionally, the poles could have any cross-sections from round to square/rectangular to triangular or any other geometric shape. Additionally, all poles could have additional hinges or could telescope to create a preferred length. Additionally, the frame 102 may be constructed of at least three support legs 112 and any number of additional support legs 112. Alternatively, the frame 102 may be as few as one or two support legs where external support is provided.

Figure 52:
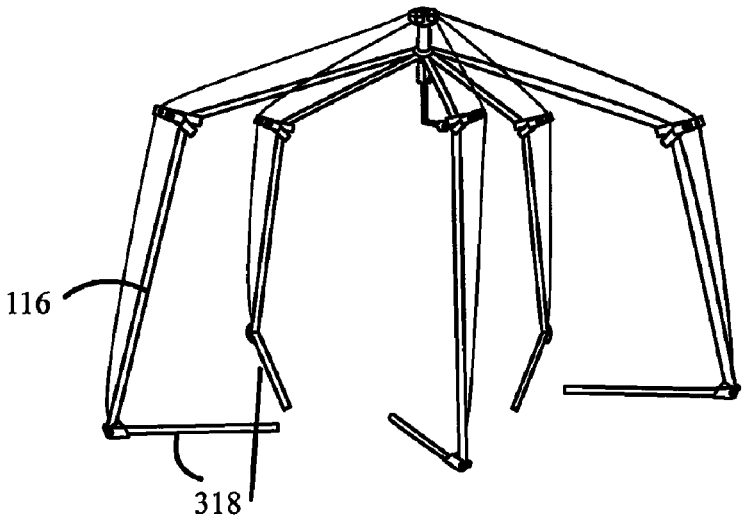
FIGS. 52-54 are several views relating to an alternative to a telescoping rod according to certain embodiments.
Figure 53:
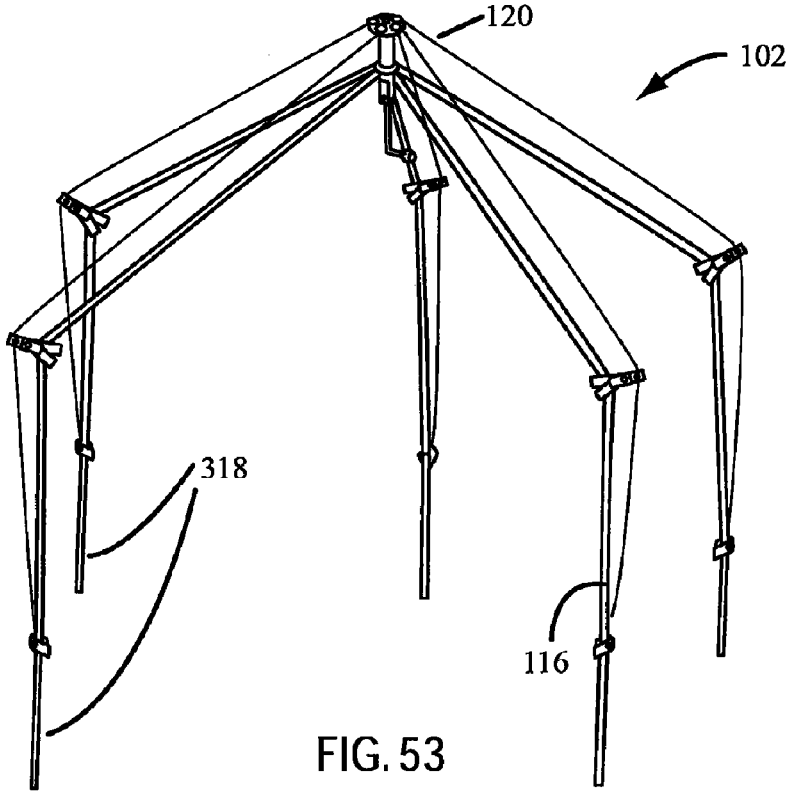
Figure 54:
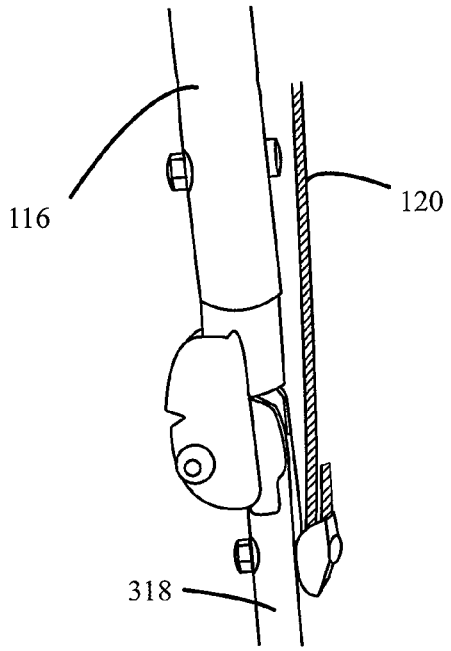

As shown in FIG. 52, rather than telescoping rods 118, rods 318 may have a hinged attachment to the wall pole 116 and thus may have a collapsed position as shown. As the rods 318 are rotated about the hinged connection to a straight position generally parallel with the wall pole 116, as shown in FIG. 53, the tent frame 102 will rise in a similar manner as though a telescoping rod 118 had been extended. As shown in FIG. 54, a hinge pin may be offset to cause the bottom end of the wall pole 116 to abut the top end of the rod 318 when the rod 318 is moved to its expanded position. As such, the rod 318 is prevented from over rotating. Moreover, as shown, the cable 120 may be secured to the outer surface of the rod 318. Thus, when the cables 120 are tensioned with the crank assembly 156, the tension from the cable 120 will hold the rod 318 in an expanded position preventing the rod 318 from collapsing.

Figure 55:
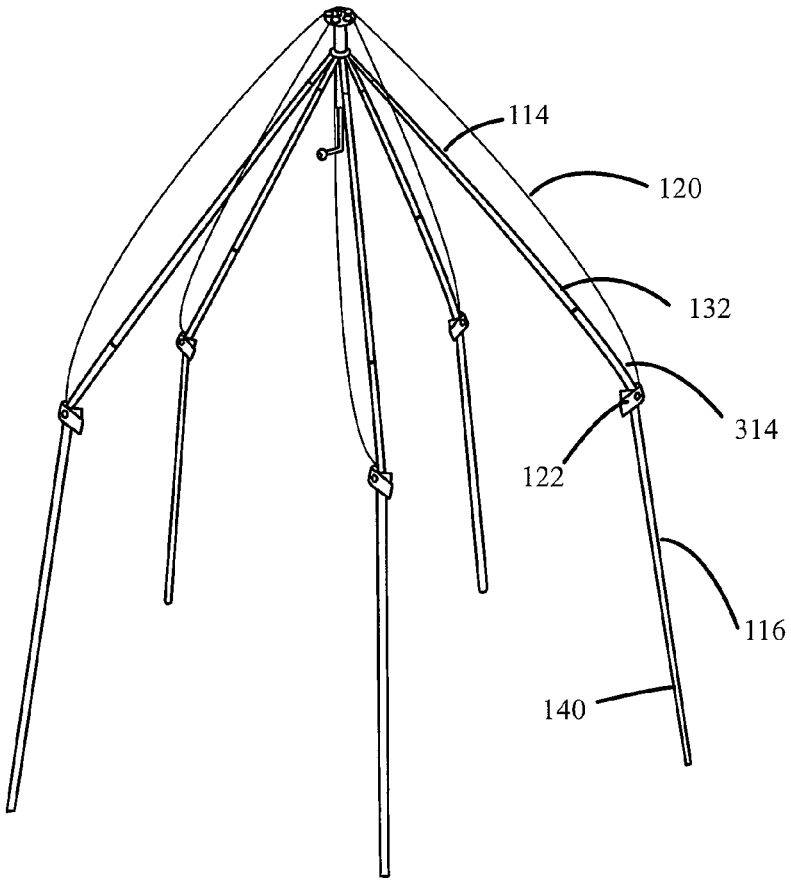
FIGS. 55-59 are several view relating to an alternative embodiment of a frame including a flexible rod between a roof pole and a wall pole according to certain embodiments.
Figure 56:
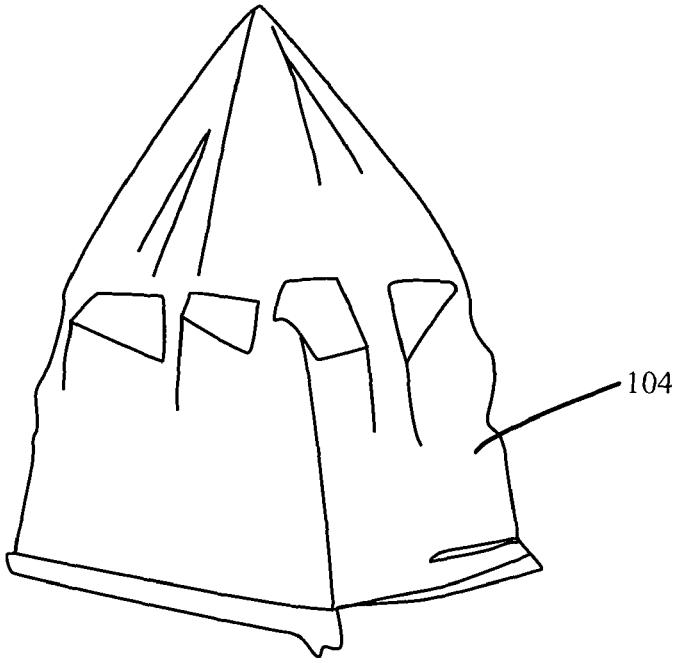
Figure 57:
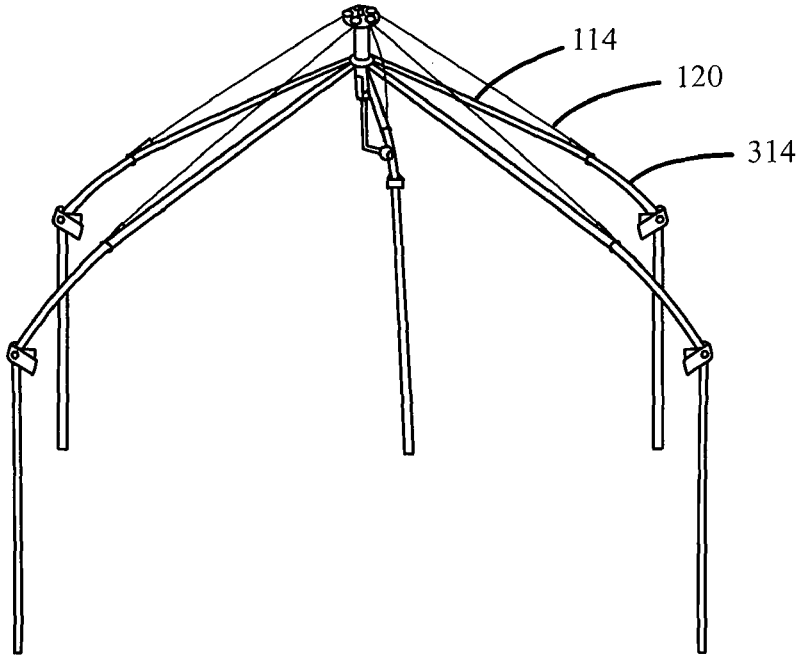
Figure 58:
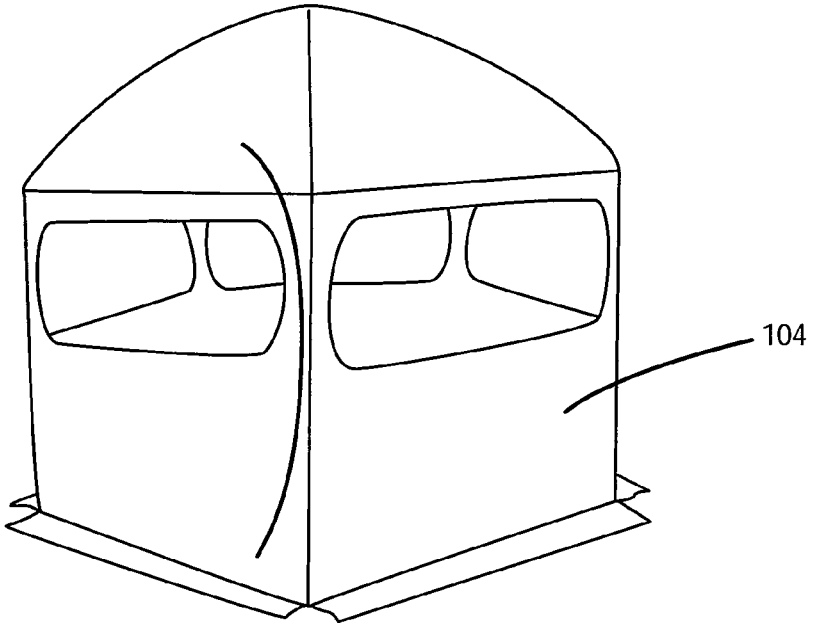
Figure 59:
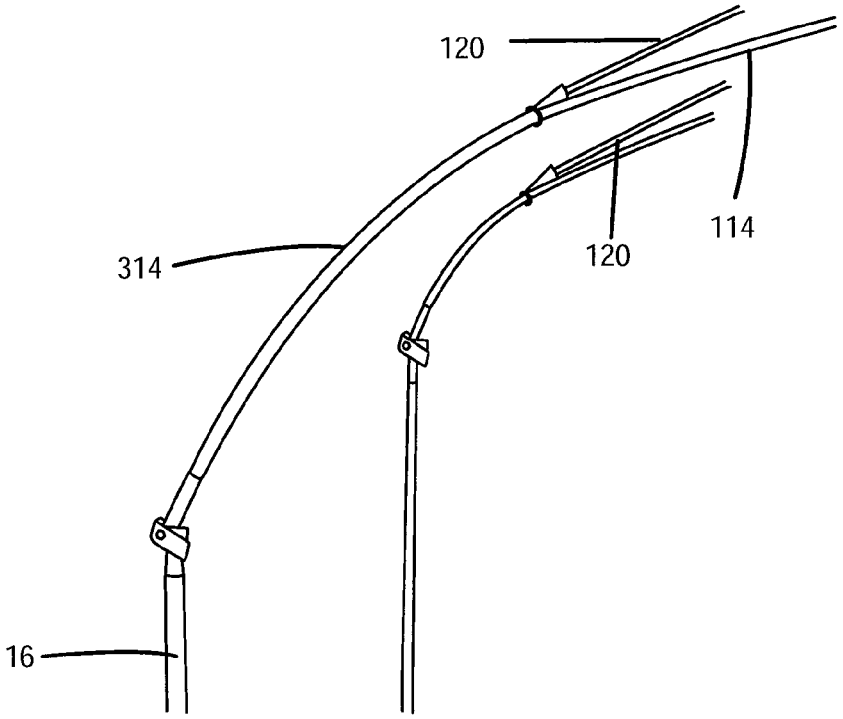

Another alternative embodiment is shown in FIGS. 55-59. In this embodiment, as shown in FIG. 55, the cable 120 does not extend to the sleeve end 140 of the wall pole 116. Instead, the cable 120 stops near the hinge end 132 of the roof pole 114. Additionally, the roof pole 114 does not extend all the way to the hinge 122. Instead, a fiberglass extension pole 314 may be connected to the lower end of the roof pole 114. Alternatively, the fiberglass extension pole 314 could be connected to the top of the wall pole 116. In this embodiment, the hoop tension provided by the shell 104 of the tent 100 holds the wall poles 116 in while the cable 120 pulls up on the roof poles 114. The connection between the roof poles 114 and the wall poles 116 is flexible thereby creating an outward force on the top of the wall pole 116 in opposition to the hoop tension in the shell 104 causing the shell 104 to be drawn reasonably taut. FIG. 56 is similar to FIG. 55, but includes a shell 104 draped over the frame 102. FIG. 57 shows the frame 102 fully expanded and FIG. 58 shows the frame 102 fully expanded with a shell 104 in place. FIG. 59 is a close up view of the cable 120, roof pole 114, fiberglass extension pole 314, and wall pole 116 of the embodiment shown in FIG. 55. Also shown is a hinged connection between the fiberglass extension pole 314 and the top of the wall pole 116.

Figure 60:
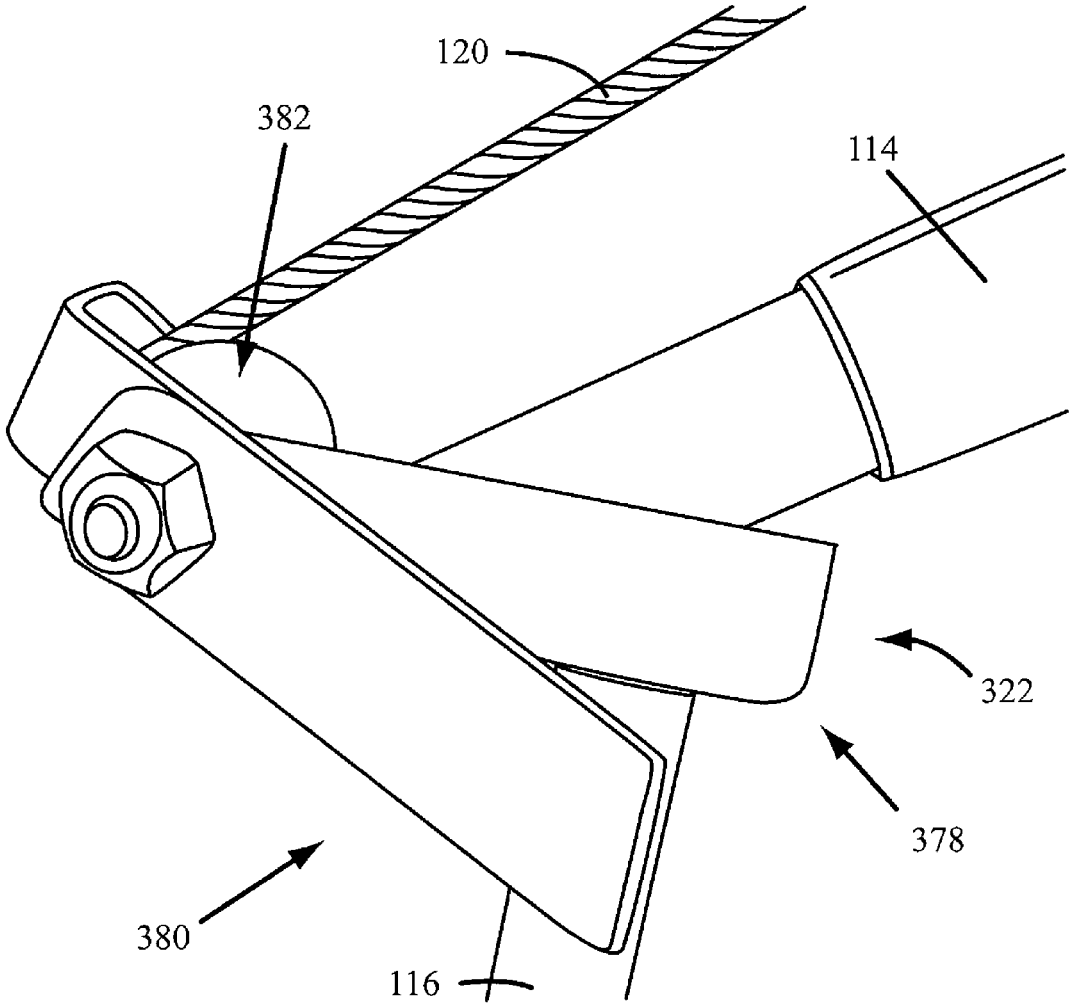
FIG. 60 is a view of an alternative hinge and cable support system according to certain embodiments.

In another embodiment, as shown in FIG. 60, a hinge 322 between a roof pole 114 and a wall pole 116 is shown. In this embodiment a separate cable extension arm 182 is not included, but is instead incorporated into the wall pole portion 380 of the hinge 322. Thus, since the cable extension arm 182 is not free to rotate, the cable 120 does not need to provide it with stability by having a bushing that receives a steel ball. Instead, a free spinning pulley 382 is shown. It is noted that this may limit the amount of outward pushing force that can be generated by tensioning the cable 120 because the distance between the cable 120 and the hinge 322 is not as large. The leg of the hinge 322 supporting the pulley 382 could be extended in FIG. 60, however, because of its rigid nature relative to the wall pole portion 380 of the hinge 322, this would cause the collapsed frame 102 to occupy a larger volume.

Figure 61:
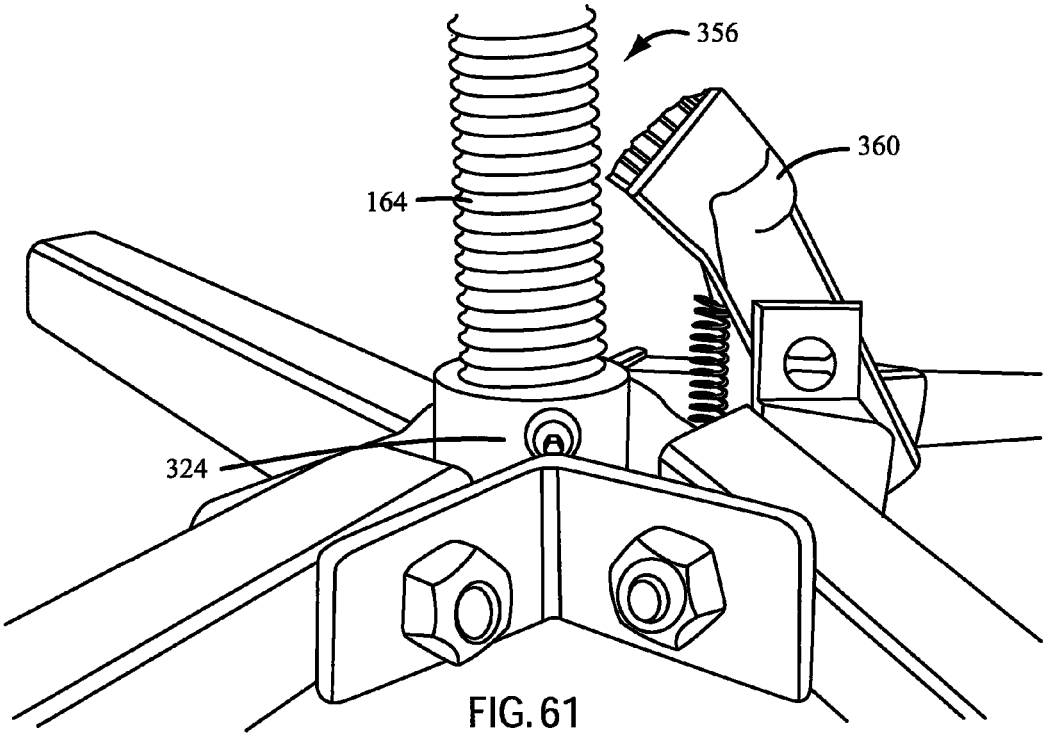
FIGS. 61-62 show an alternative crank assembly according to certain embodiments.
Figure 62:
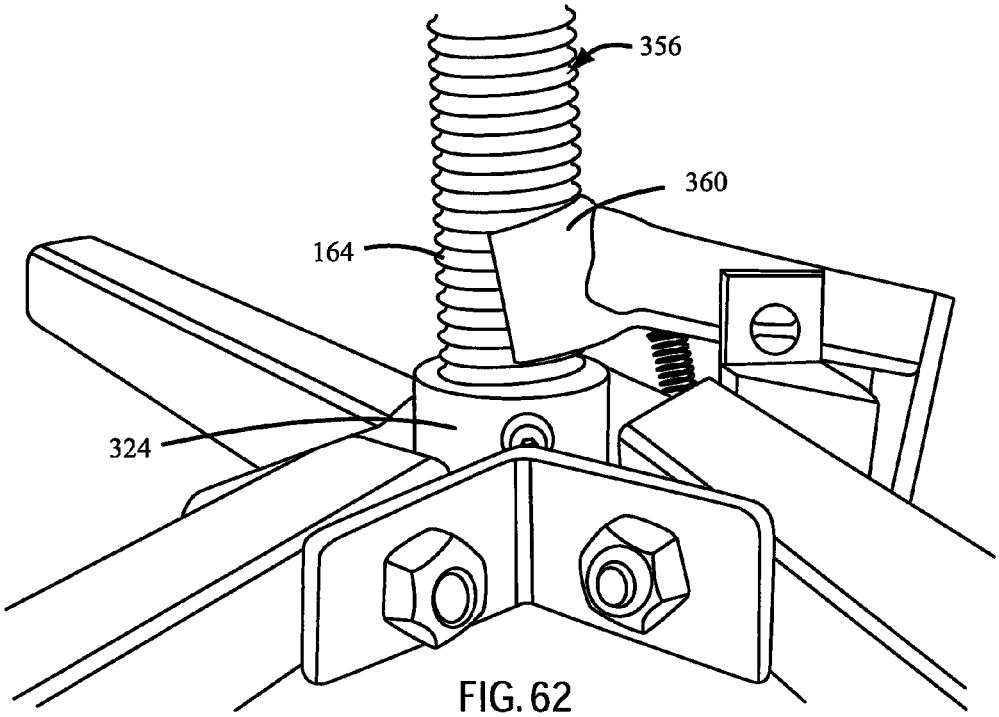

In another embodiment shown in FIG. 61, a roof pole hub 324 and crank assembly 356 are shown that allow for more quickly tensioning the cables 120. That is, the roof pole hub 324 is not threaded and thus provides for slidable motion of the threaded rod 164 of the crank assembly 356. Once the frame 102 is set up and the cables 120 need to be tensioned, the user may be able to simply press upward on the crank assembly 356 to create tension in the cables 120. Then, to secure the threaded rod 164 in the upward position and provide for further tightening of the cables 120, a threaded gear 360 may be engaged. The threaded gear 360 may be hinged and anchored by a spring as shown so as to pivot out of the way when the threaded rod 164 is advanced upward, but to maintain contact with the threaded rod 164 as shown in FIG. 61. Thereafter, as shown in FIG. 62, turning the threaded rod 164 will cause the threads of the threaded gear 360 to engage the threads of the threaded rod 164 and draw the threaded gear 360 down against the top of the roof pole hub 324. The threaded rod 164 can then be further advanced by turning it. In addition, the threaded rod 164 is prevented from withdrawing from the roof pole hub 324 by the threaded gear 360. In an alternative embodiment, the engagement of the threads on the threaded rod 164 with threads on the interior of the roof pole hub 124 may be selectively controlled with a lever which moves a clamping threaded gear 560 into and out of position. This may be similar to that found on a typical work piece clamp on a chop saw.

It is noted here that alternatives to a crank assembly 156, 356 may include a hydraulic pump, a scissor type lift, or a ratchet. Additionally, the cable 120 could take the form of a rope, wire, strap, rod, or other tension member known in the art.

For purposes of minimizing weight and thus maximizing portability, several of the elements of the tent 100 may be made from plastic, aluminum, magnesium, or other suitable light weight materials. The following figures show elements adapted to be made from plastic. Those skilled in the art will understand and appreciate that several other elements of the tent 100, not further described below, may also be made from plastic or other light weight materials.

Figure 63:
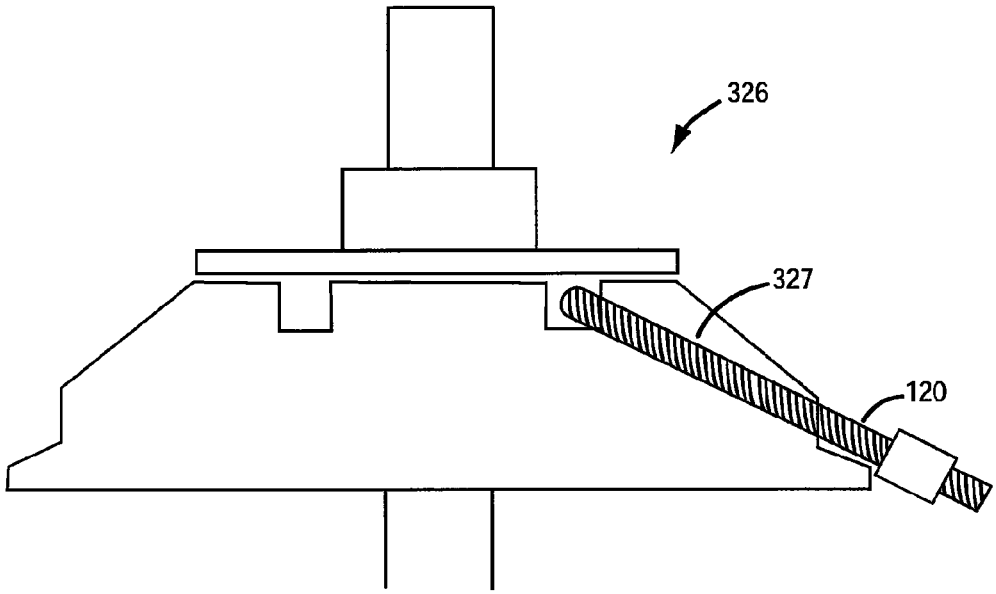
FIGS. 63-76 relate to alternative embodiments of several elements of the frame where the elements may be made of a light weight material according to certain embodiments.
Figure 64:
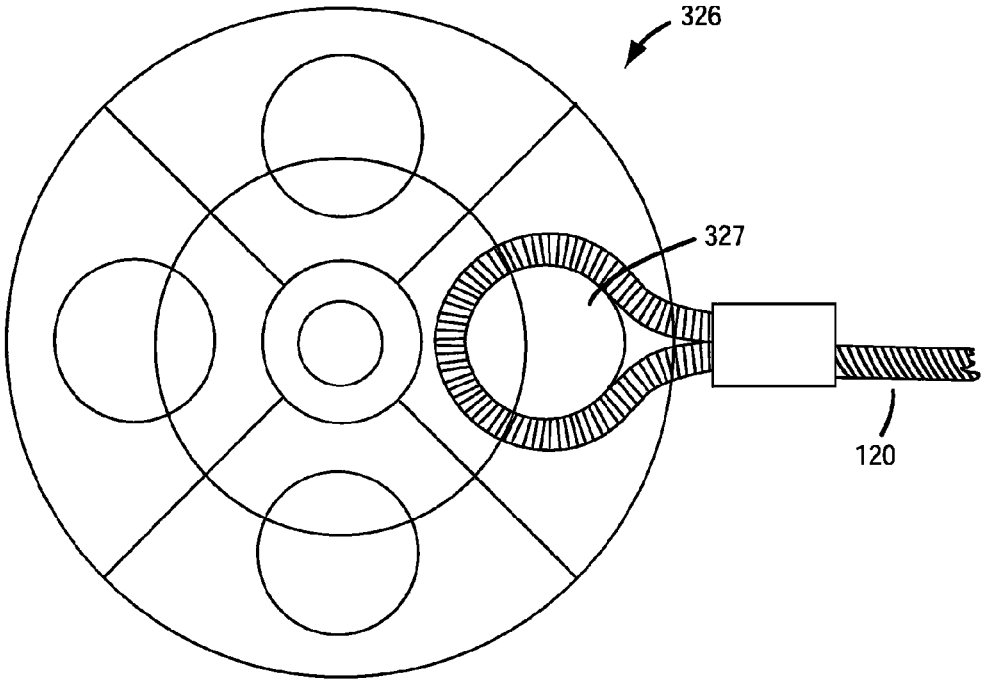

FIGS. 63 and 64 show a cable hub 326 according to one embodiment. The cables 120 shown include looped ends as before. As such, the cable hub 326 includes upward projecting cylindrical portions 327 that receive the loops of the cables 120. Additionally, the surface of the cable hub 326 adjacent to the cylindrical portions 327 may be sloped to approximate the slope of the cables 120 as they travel toward the hinge 122 of the support leg 112. A portion of the top surface of the cylindrical portion may also be sloped to facilitate easier attachment of the cables. The top of the hub 326, however, may be flat to accommodate a washer and a nut placed over the top of the hub 326 to secure the cables 120 in place and prevent them from slipping off the top of the cylindrical portions 327. The washer and nut may be secured via a threaded stud embedded in the cable hub. Alternatively, the threaded stud may pass through an internal vertical bore and be prevented from rotating when the top washer and nut are tightened by an opposing nut received into a recess on the bottom of the hub 326. In both instances described, the threaded stud may have a blanked portion (e.g. no threads) extending downward from the cable hub 326 to the threaded rod 364.

Figure 65:
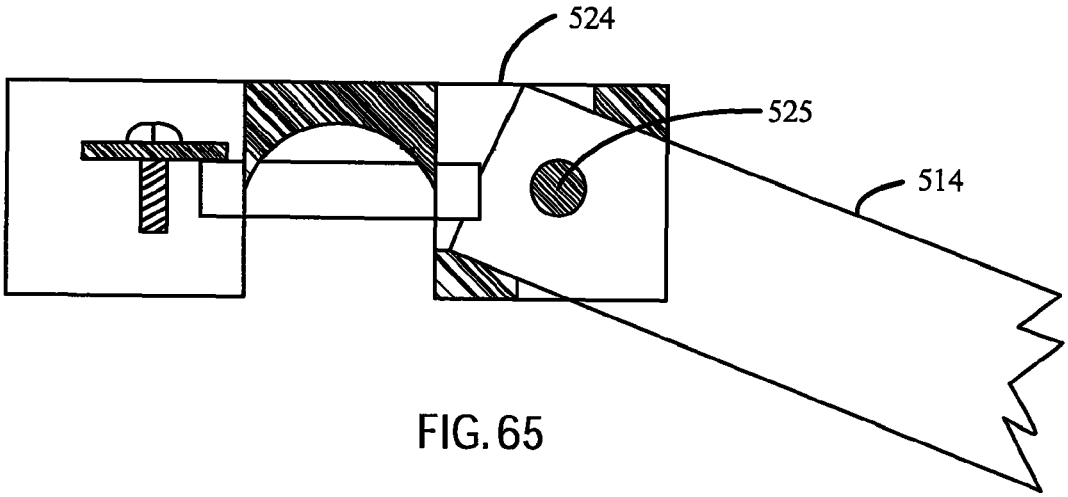
Figure 66:
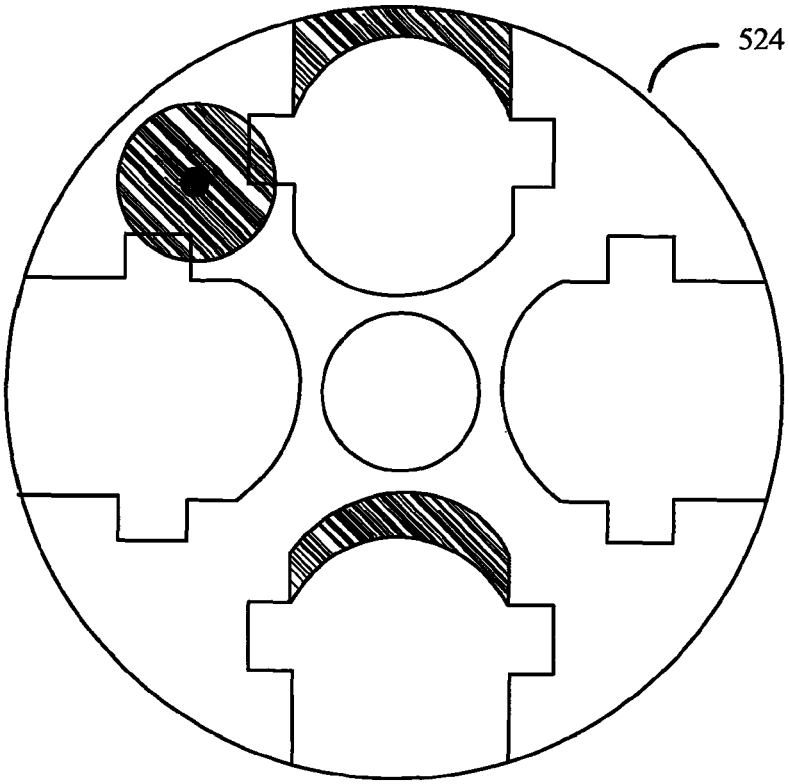
Figure 67:
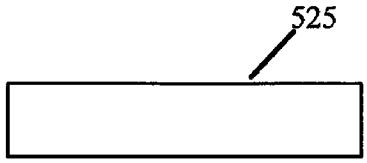

FIGS. 65 and 66 show a roof pole hub 524 according to another embodiment. As shown, the roof pole hub 524 is adapted to receive roof poles 514 from several sides. The hub 524 includes a block out location for each roof pole 514 to nest in the side of the hub 524. Adjacent to each block out and on either side of each block out is a an additional block out to receive a transverse pin 525 (shown in FIG. 67) positioned through the end of the roof pole 514. Also shown is a washer anchored with a screw from the top of the hub 524 and positioned to extend over the top of two adjacent transverse pins 525 to secure them in their block out positions. The roof pole hub 524 may include a threaded bore to threadably engage the threaded rod 164 from the crank assembly.

Figure 68:
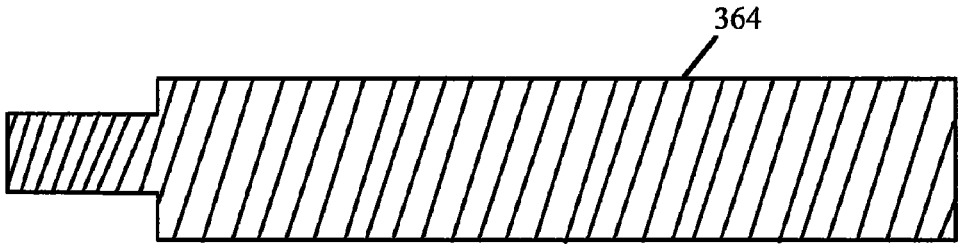
Figure 69:
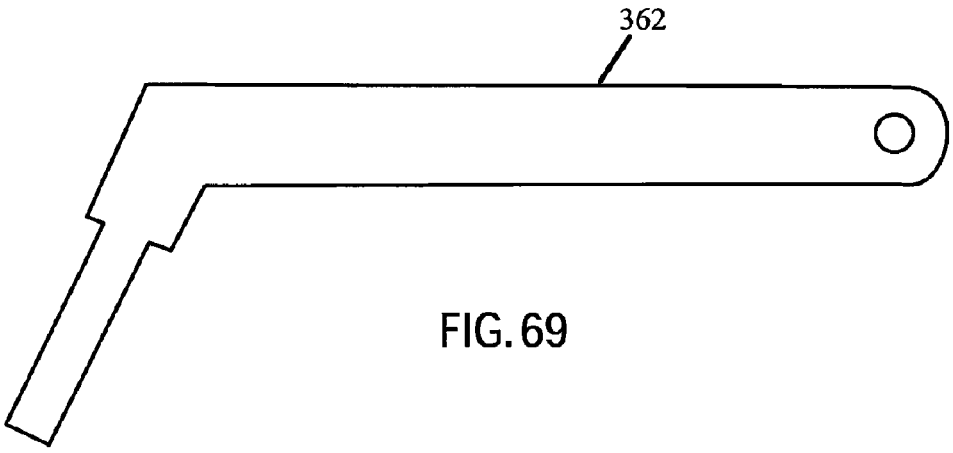
Figure 70:
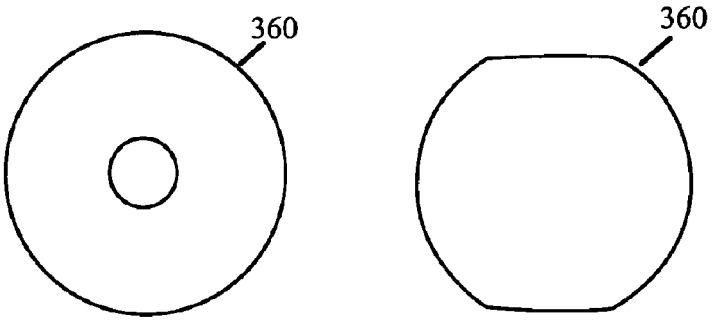

FIGS. 68-70 show a crank assembly 356 according to another embodiment. FIG. 68 shows a threaded rod 364 for receiving a cable hub 326 on one end and a crank assembly handle 362 on a stepped end. The threaded rod 364 may have a vertical bore in the top of the threaded rod 364 for receiving the blanked portion of the stud from the cable hub 326. Thus, the threaded rod 364 may be free to rotate freely relative to the cable hub 326, but also provide vertical upward force on the cable hub 326. The stepped end of the threaded rod 364 may have a horizontal hole for receiving a bolt or pin from the handle 362. FIG. 69 shows a crank assembly handle 362 according to another embodiment with a stepped portion for receiving a knob 360 and a saddle type end to receive the bottom of the threaded rod 364. The crank assembly handle 362 also includes a bore for receiving a pin or bolt to secure the handle 362 to the threaded rod 364. The handle 362 also includes a bend for accommodating overhead cranking of the handle 362. FIG. 70 shows another embodiment of a knob 360 with a bore adapted to loosely receive the smaller diameter portion of the handle 362 so as to freely spin.

Figure 71:
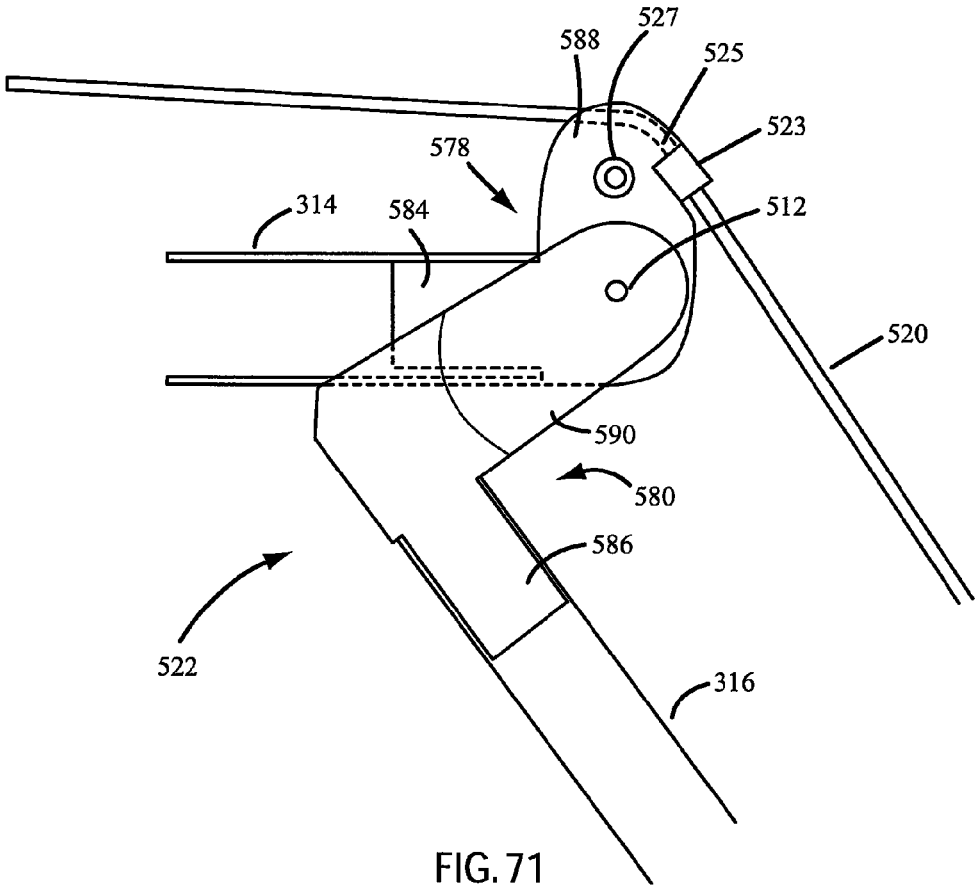
Figure 72:
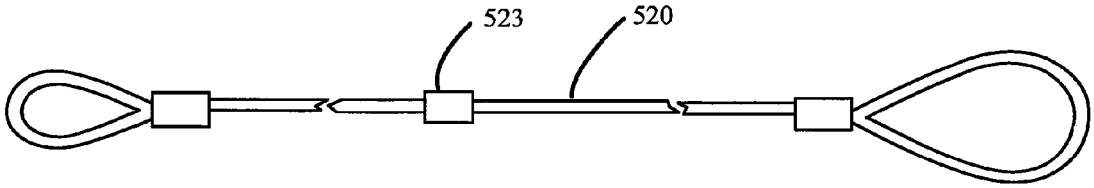

FIGS. 71-75 show another embodiment of a hinge 522 between a roof pole 314 and a wall pole 316. The roof pole portion 578 and the wall pole portion 580 include a tubular portion 584,586 that sleeves inside their respective poles. The roof pole portion 578 of the hinge 522 may further include a solid bar portion 588 extending substantially orthogonally to the tubular portion 584. The wall pole portion 580 may further include a pair of tabs or plates 590 also extending substantially orthogonally from the tubular portion 586 and spaced to sandwich the solid bar portion 580 of the roof pole portion 578 between them. The solid bar 588 and the pair of plates 590 may be connected with a hinge pin 592 near the end of the plates 590 of the wall pole portion 580 and near the base of the solid bar portion 588 of the roof pole portion 578. The upper surface of the wall pole portion 580 may be concave for receiving and nesting tightly against the bottom surface of the roof pole portion 578 and preventing further rotation once expanded. The outer surface of the roof pole portion 578 also may include a recess 525 adapted to receive a cable stop 523. As shown in FIG. 72, the cable 520 includes a loop at each end for attachment to the cable hub 326 at one end and an anchor point at the other. As also shown, the cable 520 may include a cable stop 523 in position to fit into the recess 525 of the roof pole portion 578 shown in FIG. 71. Offset from the hinge pin 592, the roof pole portion 578 may also include a nub 527 on each side of the solid bar portion 588 for receiving a cable guide swivel 529 (not shown). For more information regarding a cable guide swivel see FIGS. 76 and 82-85.

Figure 73:
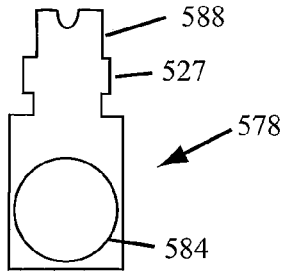
Figure 74:
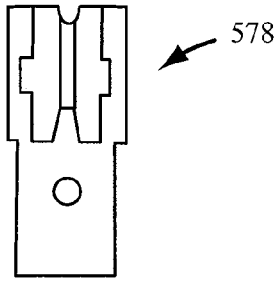
Figure 75:
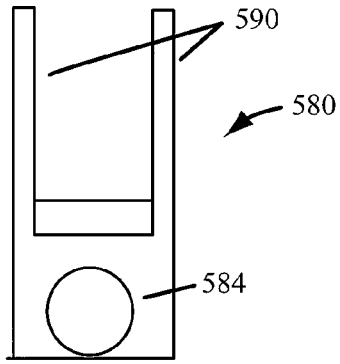

Further details of the roof pole portion 578 and the wall pole portion 580 are shown in FIGS. 73-75. FIG. 73 shows a butt end inside view of a roof pole portion 578 showing the tubular portion 584 and the solid bar portion 588 extending substantially orthogonally thereto with a concave slot for receiving the cable 520 and a nub 527 on each side for receiving a cable guide swivel 529. FIG. 74 shows a top view of the roof pole portion 578. FIG. 75 shows a butt end view of a wall pole portion 580 showing a tubular portion 584 and a pair of tabs or plates 590 extending substantially orthogonally thereto.

Figure 76:
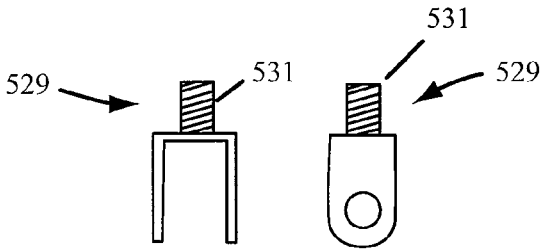

FIG. 76 shows two views of a cable guide swivel 529. The cable guide swivel 529 may be attached to the nubs 527 of the solid bar portion 588 of the roof pole portion 578 of the hinge 522. The U-shaped cable guide swivel 529 may straddle the solid bar portion 588 and remain slightly offset from the surface of the solid bar portion 588, allowing the cable 520 to pass there through and allowing the cable guide swivel 529 to pivot about the nubs 527. The cable guide swivel 529 may also include a threaded stud 531 extending away from the hinge 522 for extension through a grommet on the shell 104 of the tent 100 acting as a support point for the shell 104 and allowing the shell 104 to be secured to the frame 102.

Figure 77:
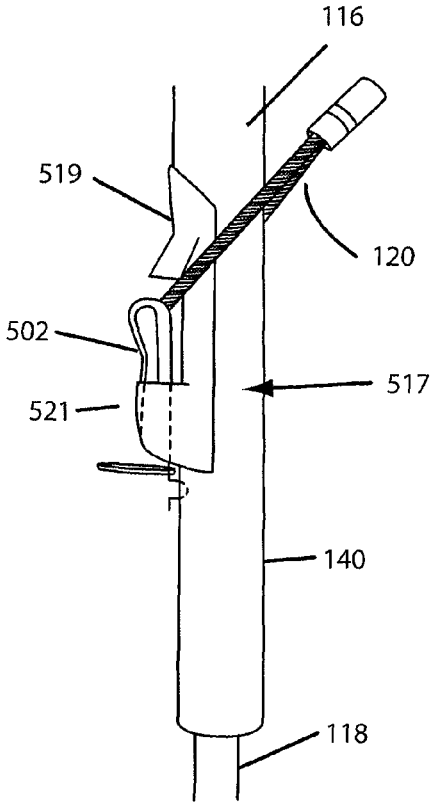
FIGS. 77 and 78A-78E relate to an alternative cable anchoring system at the wall pole according to certain embodiments.
Figure 78A:
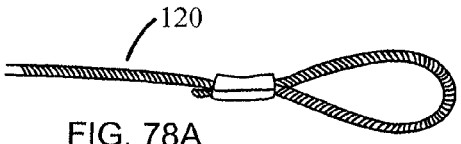
Figure 78C:
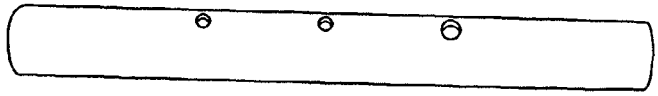
Figure 78B:
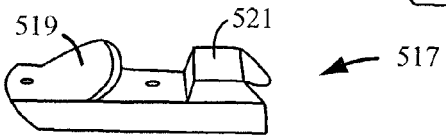
Figure 78D:
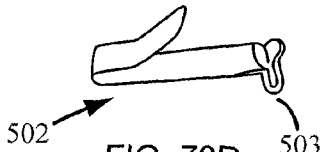
Figure 78E:
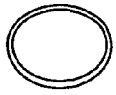

FIG. 77 shows an alternative embodiment of the attachment of the cable 120 to the sleeve end 140 of the wall pole 116. The cable loop is looped around the wall pole 116 and also around a cable anchor 517. The cable anchor 517 includes a raised protrusion 519 on an upper end, the raised protrusion 519 having a contour similar to that of an angled cable loop. The cable anchor 517 has a concave underside and is mounted on the wall pole 116 with two fasteners passing through the cable anchor 517 and into threaded bores in the wall pole 116. Alternatively the bores may not be threaded and the fasteners may be rivets. The cable anchor 517 also includes a tunnel like structure 521 for securing a spring ball 502. The spring ball 502 may be positioned within the tunnel 521 so as to force the ball portion 503 of the spring ball 502 against the surface of the wall pole 116. The ball portion 503 of the spring ball 502 may be positioned outside a bore through the wall pole 116. As such, when the telescoping rod 118 is in place in the wall pole 116, the spring ball 502 is prevented from fully entering the bore. However, when the telescoping rod 118 is extended, the ball portion 503 of the spring ball 502 may fully enter the wall pole 116 and as such, may prevent the telescoping rod 118 from re-entering the wall pole 116. In order to retract the telescoping rod 118, a ring may be placed under the arm of the spring ball 502 to allow the ball portion 503 to be pulled from the bore and allow the telescoping rod 118 to be retracted. The elements of the connection are more clearly shown individually in FIGS. 78A-78E.

Figure 79:
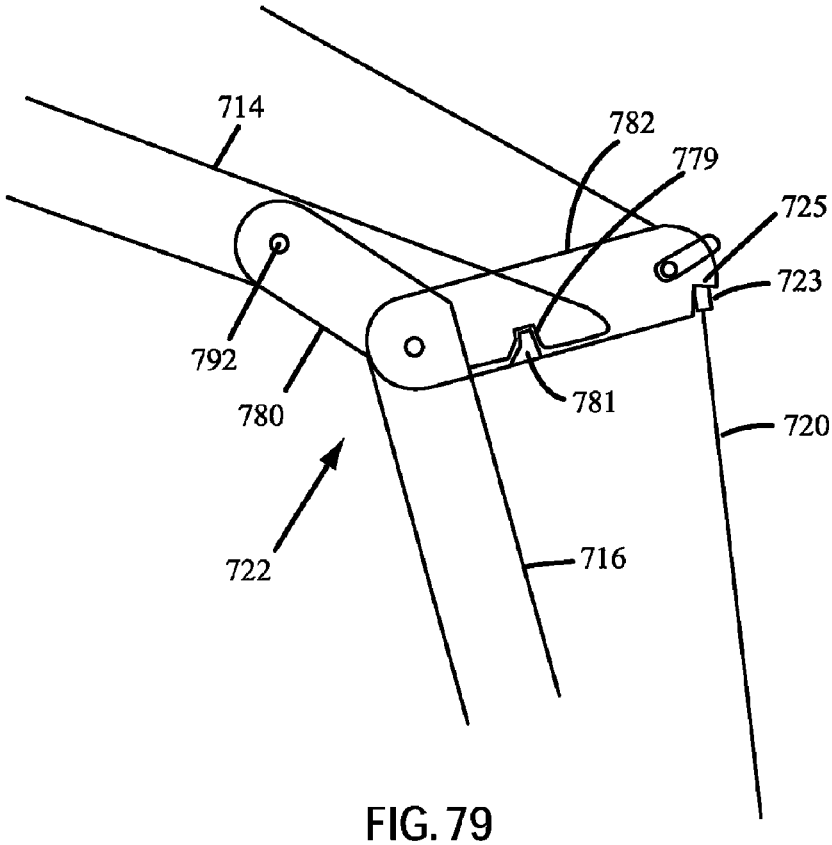
FIG. 79 is a view of yet another alternative for a hinge according to certain embodiments.
Figure 90:
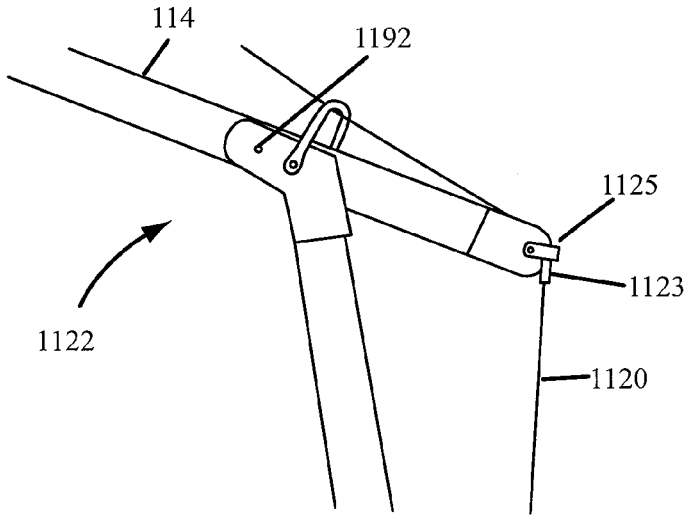
FIG. 90 is a view of yet another alternative for a hinge according to certain embodiments.

Still another alternative for the hinge 722 is shown in FIG. 79. In this embodiment, the wall pole portion 780 may extend diagonally from the top of the wall pole 716 and may straddle the roof pole 714. The wall pole portion 780 may be connected to the roof pole 714 with a hinge pin 792. The wall pole portion 780 may also include a concave surface for nesting against the bottom surface of the roof pole 714 and preventing full rotation of the roof and wall pole 714, 716 relative to one another and providing a stop point for the expansion of the frame 102. The roof pole 714 may extend beyond the hinge pin 792 and have a slot 779 for receiving a tooth 781 of the cable extension arm 782. The cable extension arm 782 may pivot about a pin located near the diagonal transition between the wall pole 716 and the wall pole portion 780 of the hinge 722. The cable extension arm 782 may extend upward and outward and may have a tooth 781 for engaging the slot 779 on the end of the roof pole 714. In the present embodiment, the cable extension arm 782 may also include a recess 725 for a cable stop 723. Once in position, and the cable 720 is tensioned, the cable stop 723 will maintain an upward force on the cable extension arm 782 and maintain the tooth 781 of the cable extension arm 782 in the slot 779 of the roof pole 714. As such, as long as there is tension on the cable 720, the hinge 722 remains in a fixed position. Still another embodiment of a hinge 1122 is shown in FIG. 90. This hinge 1122 is similar to the hinge 722 in that the roof pole 1114 may extend beyond the hinge pin 1192. However, rather than having a slot for receiving a tooth, the roof pole 1114 extends to the cable 1120 and has a recess 1125 for a cable stop 1123.

Figure 80:
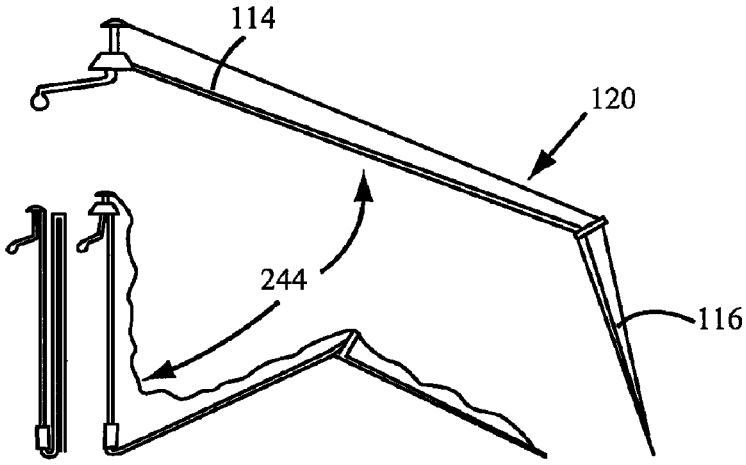
FIG. 80 relates to an alternative support leg with an additional hinge directed at tensioning the cable according to certain embodiments.

In still another embodiment, as shown in FIG. 80, a support leg 112 is shown with an additional hinge 244 for tensioning of the cables 120, and to shorten the length of the tent in its final collapsed position. As shown, the roof pole 114 has a hinge 244 at approximately its midpoint. As such, if the cable 120 is fixed at each end prior to setting up the tent 100, the hinge 244 in the roof pole 114 may be the final step in setting up the tent 100 and may create tension in the cable 120. Also shown is the collapsed configuration of a tent 100 with such a roof pole hinge 244. It is noted here that several alternatives to a crank assembly 156 may be used to create tension in the cable 120. These alternatives may include a leverage handle for extending the cable extension arm 182 to tension the cables 120 or include a threaded extension arm 182 that can be extended outward to tension the cables 120. Alternatively, similar to FIG. 80, a hinge could be included in the wall pole 116 in lieu of the roof pole 114 or both could include a hinge. Alternatively, the roof or wall pole 114,116 or both could include a telescoping portion for extending each and thus tensioning the cable 120. This could include a leverage handle for forcing the poles to extend and lock in place. Alternatively, the poles could screw outwards. In still another alternative, turnbuckles could be used on the cables 120 to create the tension. The crank assembly 156 shown and described with respect to FIG. 17, however, is efficient in that it provides cable tension on all cables 120 through one central process.

In yet another alternative a combination of a moveable cable hub 126 may be used in conjunction with one of the above mentioned methods of tensioning the cables 120. That is, the rod 164 extending through the roof pole hub 124 and supporting the cable hub 126 may be telescoped down in the collapsed position to save on the length of the collapsed tent 100. Then, once the tent 100 was initially expanded, the cable hub 126 and rod 164 may be telescoped upward, slidably, screwed or otherwise, and locked in place. Once this initial process was complete, further cable tensioning methods mentioned above could be used.

Figure 81A:
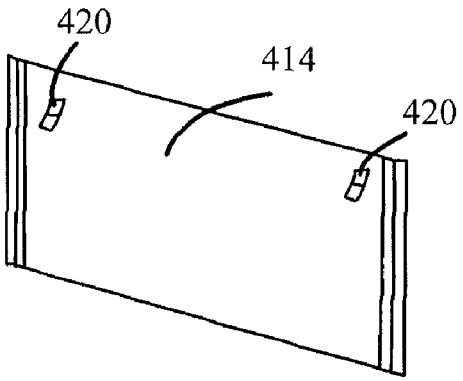
FIGS. 81A-81C are each interior views of an alternative window curtain according to certain embodiments.
Figure 81B:
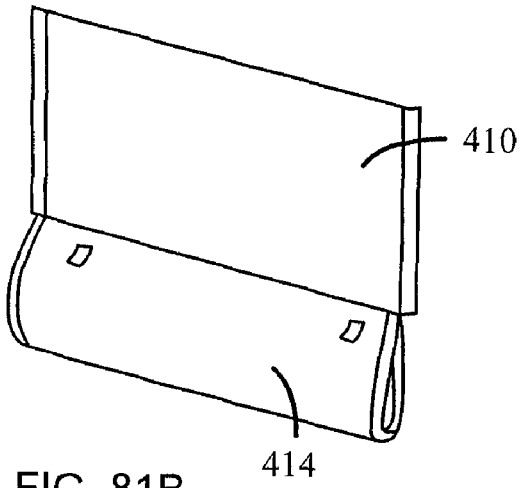
Figure 81C:
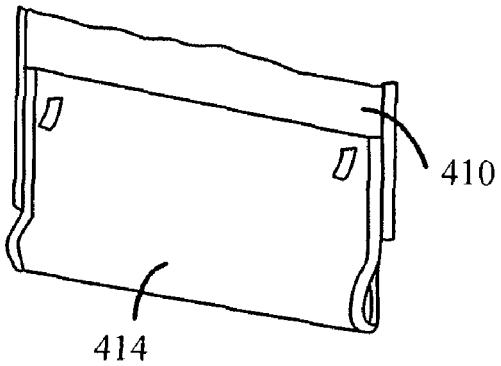
Figure 82:
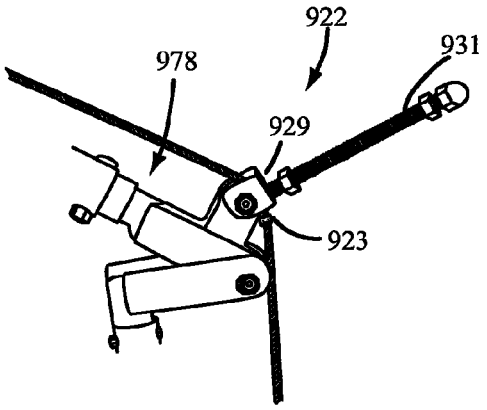
FIGS. 82-85 relate to an alternative embodiment of a hinge including a cable guide swivel and a threaded stud according to certain embodiments.
Figure 83:
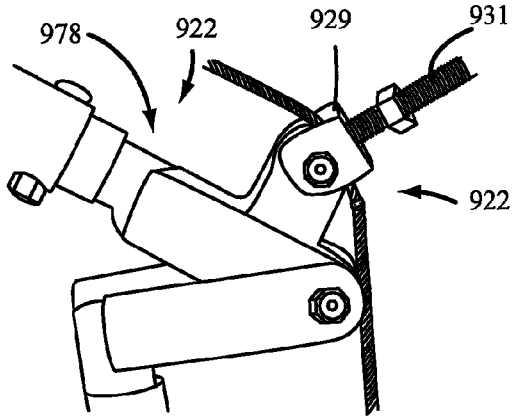

In still another embodiment, an alternative window curtain system is shown. The window curtain 414 shown in FIGS. 81A-81C is fastened to the bottom edge of the window opening 410 in the shell 104. As such, when the tabs 420 in the upper corners of the window curtain 414 are grasped to lower the window curtain 414, the curtain 414 may fold inward creating a pouch shape or loop shape if viewed from the end. It is noted that the window curtains 414 of the present embodiment can only be opened in one direction due to the fixation to the shell 104. As such, in an alternative embodiment, the window curtain 414 may extend only partially (e.g. halfway) up the window opening 410. In this embodiment, an additional window curtain 414 may extend from the top of the window opening 410 to the mid-height. The top and bottom curtains 414 could be opened alone or in combination to created various heights of exposed window opening 410. In one embodiment, a thin opening may be at the center of the window opening 410 may be created so a sitting person can see straight out a approximately eye level. This embodiment may help prevent wind and water from entering the tent 100 when the curtain 414 is closed. This is in contrast to the sliding curtains 214 shown in FIGS. 27-30 which are not fixed to the shell 104 at their bottom or top.

In still another embodiment, a window curtain 614 may slide to the side rather than vertically. In this embodiment, a window opening 610 may not be as wide as shown in previous embodiments, thus allowing for room for the window curtain 614 to slide before intersecting with an adjoining wall. In this embodiment, the window opening 610 may be a slot type window approximately 14" wide by approximately 3" to 4" tall and may be located at eye level. Alternative sizes will be apparent to those of skill in the art and are thus within the scope of the present invention.

Figure 84:
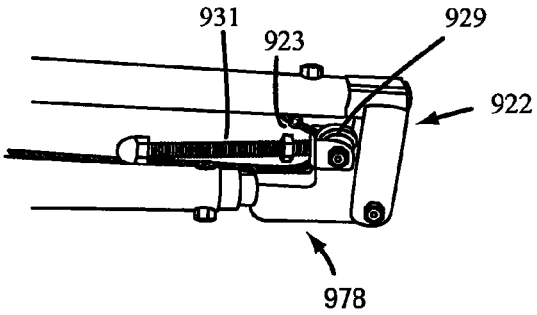
Figure 85:
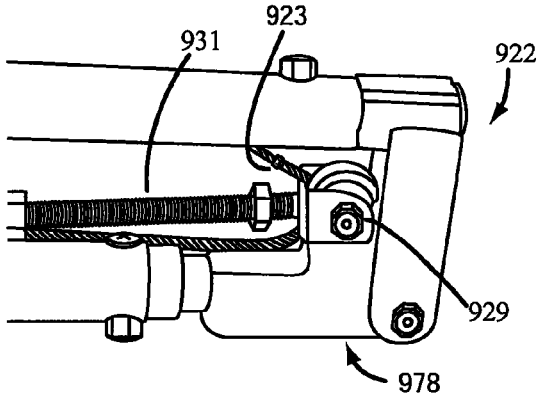

FIGS. 82-85 show yet another embodiment of a hinge 922. In this embodiment, a hinge 922 similar to that of described in FIG. 71 is shown. The hinge 992 in this embodiment may be made from a metal material or any other suitable material. Additionally, in this embodiment, a cable guide swivel 929 is shown pivotally attached to the roof pole portion 978 of the hinge 922. As with FIG. 71, a cable stop 923 is included. As shown in FIGS. 84 and 85, the collapsed position of the hinge 922 is shown. Also, extending from the cable guide swivel 929 is a threaded stud 931. In this embodiment, the threaded stud 931 is relatively long and includes a nut near the cable guide swivel 929 as well as a nut near the end of the threaded stud 931 and a cap nut.

Figure 86:
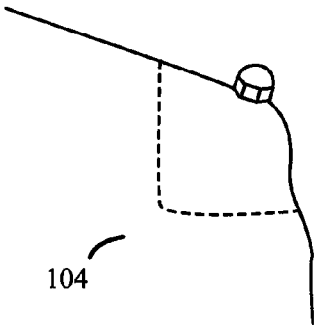
FIG. 86-89 relate to the connection between a threaded stud on a frame and a shell according to certain embodiments.
Figure 87:
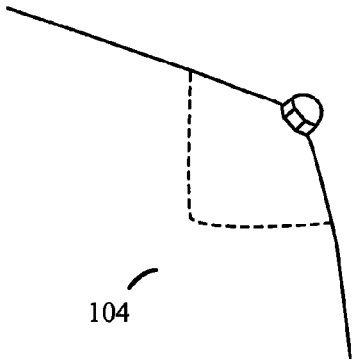
Figure 88:
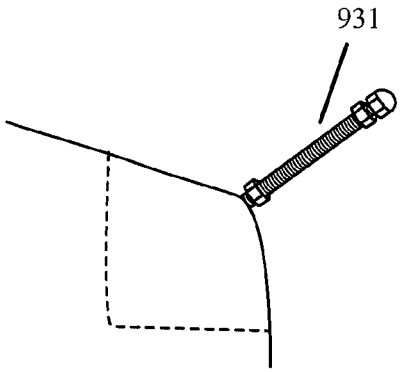
Figure 89:
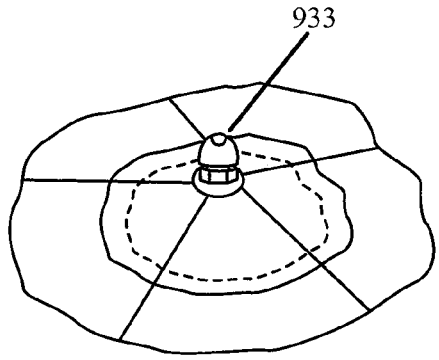

FIGS. 86-89 show the interaction between several threaded studs and the tent shell 104. In FIG. 86, a threaded stud is shown extending from a cable guide swivel 929. In the present position, the telescopic rods 118 at the bottom of the frame 102 have not been extended and the crank assembly 156 has not tensioned the cables 120. As such the threaded stud is positioned somewhat vertically. In FIG. 87, these items have been completed and the shell 104 has tightened and rotated the guide swivel 929 to approximately 45 degrees. In FIG. 88, an extended threaded stud 931 is shown similar to that shown in FIGS. 82-85. This extended threaded stud 931 may function to support a rain fly, which prevents water from resting on the surface of the shell 104. As such, the rain is less likely to soak through the tent shell 104. The presence of a rain fly may also allow for venting in the roof of the tent 100 without causing water to enter the roof. FIG. 89 shows a similar threaded stud 933 extending from the top of the cable hub 126 through the top of the tent shell 104. This stud 933 may also be extended like the stud of FIG. 88 to support a rain fly. In one embodiment, the rain fly may cover the whole roof and extend partially down the walls. The fly may have eyelets in all roof corners and at the top center of the roof. Additionally, the portions of the fly extending down the walls may be secured to a bungee extending from the fly to an anchor point on the tent 100 below the bottom of the rain fly. Preferably this anchor point may be near a tent corner. In many cases, the shell 104 of the tent may be reinforced at attachment locations by sewing reinforcing patches on the outer surface of the shell 104 to prevent tearing.

In still another embodiment, a tent frame 102 may be used where some of the support legs 312 do not have an associated wall pole or telescoping rod. In this embodiment, the cable 120 associated with this particular support leg 312 may be attached to the cable hub 126 at one end and the end of the roof pole 114 at the other. As such, the tension in the cable will act to lift the opposite end of the roof pole 114 and may be used to prevent the roof 206 from sagging in certain circumstances.

In another embodiment, the shell 104 may be adapted to hang and be supported from the frame 102 with tab loops through which the poles of the frame 102 may be sleeved. Alternatively, the shell 104 may be adapted to rest on the poles of the frame 102 and a rain/wind fly may be included to rest on the cables 120.

In another embodiment, the tent 100 may include stakes which are inserted through loops in the bottom perimeter of the tent for further support and tautness. Additionally, the tent 100 may include ropes or ties extending from the hinge corners of the tent 100 downwardly angling away from the tent 100. The opposite end may then also be staked to the ground.

In yet another embodiment, the shell 104 and frame 102 of a tent 100 may be adapted to provide an open wall canopy. As such, the shell 104 may not have walls, but only a roof. In this embodiment, the cables 120 may extend beyond the hinge to a secure point near the hinge end of the wall pole rather than the sleeve end. Alternatively, the cables 120 may attach to the hinge end of the roof pole. The hinge 122 in this embodiment may have a spring ball or other mechanical locking mechanism.

In still another embodiment, the tent may include additional cables separate and apart from the cables 120. These additional cables may be placed to provide additional lateral support in the form of cross bracing between adjacent support legs or in other positions that will stiffen the structure. These additional cables may be positioned to avoid causing obstructions within the tent and may also be positioned to avoid interfering with the collapsibility of the tent. It is noted that a plurality of positions will be apparent to those skilled in the art and are within the scope of the invention.

In still another embodiment, the tent may be modularized so as to facilitate setting up a large tent. That is, several tents could be set up and placed adjacent to one another and the associated shells of the tents could be adapted to provide for one large fully or partially enclosed space.

The tent described herein is advantageous for several reasons. First, the set up of the tent may require no assembly of parts, thus providing for quick and easy set up once a destination is reached. Second, the adjustability of the frame allows for a taut shell whether the shell has expanded or shrunk. This prevents noise due to the shell flapping from wind and may prevent damage to the shell. This may also add to the strength of the tent due to the circumferential tension provided to the wall poles. This leads to a third advantage, which is that the truss type system makes for a tent that is very sturdy and strong. Fourth, the window channels described herein allow for extremely quiet opening and closing due to the slidable channels used in lieu of zippers or hook and loop or other relatively noisy securing means. Moreover, the channels may hold the window curtains taut when closed further adding to the quietness of the tent. Fifth, the shape of the frame in conjunction with the shape of the shell and the location of the windows provides for unobstructed view out of the windows.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

The description of the various embodiments is merely exemplary in nature and, thus, variations that do not depart from the gist of the examples and detailed description herein are intended to be within the scope of the present disclosure. Such variations are not to be regarded as a departure from the spirit and scope of the present disclosure.

What is claimed is:

1. A portable tent frame comprising:

at least three support legs, the support legs each comprising a means for collapsing the support leg and a means for stabilizing the support leg when in a set up position;

a means for actuating the stabilizing means;

a top;

a center; and a means for resisting radial tension and a means for resisting radial compression, the means for resisting radial tension and the means for resisting radial compression being located at the top and the center of the frame, the radial tension and radial compression being induced by the at least three support legs, wherein:

the at least three support legs each include a roof pole and a wall pole;

the means for collapsing the support leg includes a hinge;

the means for stabilizing the support leg includes a tension cable; and the means for actuating the stabilizing means includes a crank assembly.

2. The frame of claim 1, wherein the tension cable follows a path similar to the roof pole and is offset to the outside of the roof pole.

3. The frame of claim 2, further comprising telescoping rods extendable from the wall pole to raise the height of the frame relative to a supporting surface.

4. The frame of claim 2, wherein the means for resisting radial tension comprises a tension hub and the means for resisting radial compression comprises a compression hub.

5. The frame of claim 4, wherein the tension cable secured to the support leg defines a first end of the tension cable and a second of the tension cable is secured to the tension hub.

6. The frame of claim 4, further comprising telescoping rods extendable from the wall pole to raise the height of the frame relative to a supporting surface.

7. A method of setting up a tent comprising:

providing a collapsible tent in the collapsed position;

placing the collapsible tent on the ground thereby defining a center of the tent;

unfolding at least three wall poles down about a first end from a generally vertical position to a generally horizontal position, each wall pole directed radially away from the center of the tent once unfolded;

lifting at least three hinges diagonally upward away from the ground and outward away from the center of the tent, the hinge connected to an end of the wall pole near the center of the tent and connected to an end of a roof pole near the ground, wherein lifting the at least three hinges causes at least three support legs to be mostly formed; and tensioning at least three cables associated with the at least three support legs including turning a crank assembly.

8. The method of claim 7 further comprising extending at least three telescoping rods.

9. A tent comprising:

a collapsible frame, comprising:

at least three support legs, the support legs each comprising a means for collapsing the support leg and a means for stabilizing the support leg when in a set up position;

a means for actuating the stabilizing means;

a top;

a center; and a means for resisting radial tension and a means for resisting radial compression, the means for resisting radial tension and the means for resisting radial compression being located at the top and the center of the frame, the radial tension and radial compression being induced by the at least three support legs, wherein:

the at least three support legs each include a roof pole and a wall pole;

the means for collapsing the support leg includes a hinge;

the means for stabilizing the support leg includes a tension cable; and the means for actuating the stabilizing means includes a crank assembly; and a shell adapted to cover the frame, the shell having at least one window opening and at least one window curtain covering the at least one window opening, the at least one window curtain being adapted to slidably open and close.

10. The tent of claim 9, wherein at least two channels are affixed to the shell along vertical edges of the at least one window opening and at least two additional channels are affixed along the vertical edges of the at least one window curtain, the at least two channels on the shell being adapted to slidably receive the at least two channels on the at least one window curtain.

11. The tent of claim 10, wherein the at least two channels affixed to the shell are substantially the same as the channels affixed to the at least one window curtain.

* * * * *